US007909441B2

(12) United States Patent
Samoto et al.

(10) Patent No.: US 7,909,441 B2
(45) Date of Patent: Mar. 22, 2011

(54) IMAGE RECORDING APPARATUS

(75) Inventors: Kenji Samoto, Nagoya (JP); Toshio Sugiura, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1000 days.

(21) Appl. No.: 11/739,813

(22) Filed: Apr. 25, 2007

(65) Prior Publication Data

US 2007/0252875 A1 Nov. 1, 2007

(30) Foreign Application Priority Data

Apr. 28, 2006 (JP) ..... 2006-127088

(51) Int. Cl.
*B41J 2/175* (2006.01)
*B41J 3/00* (2006.01)
*B41J 2/195* (2006.01)
*B41J 2/01* (2006.01)

(52) U.S. Cl. ..... 347/85; 347/4; 347/7; 347/86; 347/87; 347/103; 347/104

(58) Field of Classification Search ..... 347/4, 7, 347/85–87, 103–104
See application file for complete search history.

(56) References Cited

U.S. PATENT DOCUMENTS 5,971,529 A 10/1999 Pawlowski, Jr. et al.

FOREIGN PATENT DOCUMENTS

EP 1726445 A1 11/2006
JP H58-58388 U 4/1983
JP H63-154354 A 6/1988
JP H05-292369 A 11/1993
JP H6-320835 A 11/1994
JP H10-128992 A 5/1998
(Continued)

OTHER PUBLICATIONS

Japanese Office Action issued in corresponding Application No. 2006-127088, dated Apr. 16, 2008.

(Continued)

*Primary Examiner* — Charlie Peng
*Assistant Examiner* — Hung Lam
(74) *Attorney, Agent, or Firm* — Baker Botts L.L.P.

(57) ABSTRACT

An image recording apparatus including a housing; a recording head which ejects droplets of one or more sorts of inks; a carriage which is provided in the housing and which carries the recording head and reciprocates in opposite directions; one or more ink supply tubes which are connected, at respective one ends thereof, to a tube connection portion of the carriage so as to supply the sorts of inks to the recording head, and is fixed, at respective fixed portions thereof, to the housing such that respective intermediate portions thereof located between the respective one ends thereof and the respective fixed portions thereof forms respective curved portions that are each convex in one of the opposite directions, wherein the ink supply tubes have respective flexibilities assuring that when the carriage reciprocates, the ink supply tubes follow reciprocation of the carriage while the respective curved portions thereof change respective shapes thereof; a pivotable support member which is supported by the housing such that the pivotable support member is pivotable about a supporting point, wherein the pivotable support member includes an arm portion which extends from the supporting point and has a support portion that supports respective portions of the respective curved portions of the ink supply tubes; and a biasing device which biases the pivotable support member in a biasing direction to cause the pivotable support member to pivot in a direction to decrease respective radii of curvature of the curved portions of the ink supply tubes.

19 Claims, 23 Drawing Sheets

FOREIGN PATENT DOCUMENTS

| | | | |
|---|---|---|---|
| JP | 10217496 | A | 8/1998 |
| JP | H11-268288 | A | 10/1999 |
| JP | H11-286101 | A | 10/1999 |
| JP | 2003011340 | A | 1/2003 |
| JP | 2005035033 | A | 2/2005 |
| JP | 2005088524 | A | 4/2005 |
| JP | 2006015706 | A | 1/2006 |
| WO | 99/47356 | A1 | 9/1999 |

OTHER PUBLICATIONS

European Patent Office; European Search Report in Application No. 07251749.3 (counterpart to the above-captioned U.S. patent application) mailed Sep. 24, 2009.

PRIOR ART

IMAGE RECORDING APPARATUS

The present application is based on Japanese Patent Application No. 2006-127088 filed on Apr. 28, 2006, the contents of which are incorporated herein by reference.

BACKGROUND OF THE INVENTION

1. Field of the Invention

The present invention relates to an image recording apparatus including a recording head that records an image on a recording medium, and a carriage that carries the recording head and reciprocates in opposite directions intersecting a feeding direction in which the recording medium is fed, and particularly to such an image recording apparatus in which an ink supply tube that supplies an ink to the recording head is connected to the carriage such that the ink supply tube can follow the reciprocation of the carriage.

2. Discussion of Related Art

As an image recording device that ejects, based on an input signal, droplets of ink to record an image on a recording medium, there is known such a device that includes a recording head having an actuator (e.g., a piezoelectric element, an electrostriction element, or a heating element), and supplies ink to the actuator so that when the actuator is deformed or heated based on an input signal, the ink is locally pressed or vaporized to eject droplets of the ink.

For example, an image recording device that is so-called a serial printer includes a carriage that reciprocates in opposite directions perpendicular to a direction of feeding of a recording medium, and a recording head that is mounted on the carriage. Each time the recording medium is fed by an incremental amount corresponding to one line, the carriage reciprocates to record the line. Ink is supplied to the recording head from an ink cartridge separate from the carriage, via a flexible ink supply tube that is connected to the recording head mounted on the carriage. The ink supply tube is long enough to follow the reciprocation of the carriage, and is provided between the ink cartridge and the carriage such that the ink supply tube is flexed to form a generally U-shaped curved portion. This image recording device is disclosed by any of Japanese Patent Application Publications Nos. 10-217496, 2003-11340, 2005-35033, 63-154354, and 2005-88524.

FIG. 23 schematically shows a conventional image recording device including a carriage 90 and an ink tube 91. The carriage 90 reciprocates in opposite directions (i.e., in leftward and rightward directions in the figure) perpendicular to a direction of feeding of a recording sheet. When the carriage 90 reciprocates, a recording head (not shown) mounted on the carriage 90 ejects droplets of ink to record an image on the recording sheet. The ink tube 91 that is led from an ink cartridge is connected to the recording head mounted on the carriage 90, such that a midway portion 92 of the ink tube 91 that is located between the ink cartridge and the carriage 90 is fixed to a portion (e.g., a frame) of a housing of the image recording device and an intermediate portion between the midway portion 92 and the carriage 90 is not fixed to any portions. Therefore, the intermediate portion of the ink tube 91 can change its shape. Although not shown in FIG. 23, the carriage 90 is moved while being driven by, e.g., a belt driving device, and is supported by one or more guide members such as a guide shaft(s) or a guide rail(s) that extend(s) in a direction of movement of the carriage 90.

As shown in FIG. 23, the ink tube 91 is led from the carriage 90 in a horizontal direction, and is flexed to have a generally U-shaped curved configuration in its plan view. When the carriage 90 reciprocates, the ink tube 91 follows the carriage 90 while a center of the U-shaped curved portion of the ink tube 91 moves. The ink tube 91 is straight in its initial shape, but when an external force is applied to the tube 91, the tube 91 is flexed. The ink tube 91 has such a flexibility that if the external force is removed from the tube 91, the tube 91 is returned to its initial, straight shape: Therefore, as shown in FIG. 23, the ink tube 91 can change its shape such that when the carriage 90 is moved in a rightward direction, a diameter of the U-shaped curved portion of the ink tube 91 increases and, when the carriage 90 is moved in a leftward direction, the diameter of the U-shaped curved portion decreases.

Meanwhile, a flexible, electrically conductive cable that is so-called a flat cable is connected, at one end thereof, to the carriage 90 so as to control the recording head. The other end of the flat cable is connected to, e.g., a main substrate. Like the above-described ink tube 91, the flat cable is led from the carriage 90, and follows the reciprocation of the carriage 90 while forming a generally U-shaped curved portion. This image recording device is disclosed by, e.g., Japanese Patent Application Publication No. 6-320835.

As explained above, the flat cable and the ink tube have such flexibilities that assure that those elements can follow the reciprocation of the carriage while changing the diameters and/or positions of the U-shaped curved portions thereof. Accordingly, the respective intermediate portions of the flat cable and the ink tube, located between the carriage and the respective midway portions of those elements fixed to the housing of the image recording device, may more or less sag downward. In particular, in the case where the flat cable and the ink tube are led horizontally from the carriage, there is a strong tendency that those elements sag downward due to their self weights and/or the weight of the ink. In addition, in a full-color-image recording device, a plurality of sorts of inks corresponding to a plurality of colors are supplied to a recording head mounted on a carriage via a plurality of ink supply tubes, respectively. Although the ink supply tubes follow the reciprocation of the carriage while individually changing their shapes, the changing of those shapes may be out of order, i.e., random.

In the case where a sufficiently broad space cannot be provided around a flat cable and/or an ink supply tube, in view of the need to reduce a height and/or an overall size of an image recording device, reciprocation of a carriage may result in enlarging respective curved portions of the flat cable and the ink tube so that the enlarged curved portions may be brought into contact with one or more peripheral members and even be damaged by the same. The damaging of the flat cable may cause breakage of one or more electrically conductive lines contained therein; and the damaging of the ink supply tube may cause leakage of ink. In addition, when the flat cable and the ink tube are contacted with the peripheral members, a load may be applied to the carriage so that the speed of movement of the carriage may be made unstable and accordingly a quality of images recorded by the recording head may be lowered.

SUMMARY OF THE INVENTION

The present invention has been developed in the above-explained background. It is therefore an object of the present invention to solve at least one of the above-indicated problems. It is another object of the present invention to provide an image recording apparatus that includes a carriage reciprocateable in opposite directions intersecting a feeding direction in which a recording medium is fed and that can prevent sagging of an ink supply tube that follows the carriage and/or enlarging of a curved portion of the ink supply tube. It is another object of the present invention to provide an image recording apparatus that includes a plurality of ink supply tubes and that can prevent the ink supply tubes from individually changing their shapes randomly.

The above objects may be achieved by the present invention. According to the present invention, there is provided an image recording apparatus, comprising a housing; a recording head which ejects droplets of at least one sort of ink and thereby records an image on a recording medium; a carriage which is provided in the housing and which carries the recording head and reciprocates in opposite directions intersecting a feeding direction in which the recording medium is fed, wherein the carriage includes a tube connection portion; at least one ink supply tube which is connected, at one end thereof, to the tube connection portion of the carriage so as to supply the at least one sort of ink to the recording head, and is fixed, at a fixed portion thereof, to the housing such that an intermediate portion thereof located between the one end thereof and the fixed portion thereof forms a first curved portion that is convex in one of the opposite directions, wherein the at least one ink supply tube has a first flexibility assuring that when the carriage reciprocates, the at least one ink supply tube follows reciprocation of the carriage while the first curved portion thereof changes a shape thereof a pivotable support member which is supported by the housing such that the pivotable support member is pivotable about a supporting point, wherein the pivotable support member includes an arm portion which extends from the supporting point and has a first support portion that supports a portion of the first curved portion of the at least one ink supply tube; and a biasing device which biases the pivotable support member in a biasing direction to cause the pivotable support member to pivot in a direction to decrease a radius of curvature of the first curved portion of the at least one ink supply tube.

In the present image recording apparatus, an appropriate portion of the first curved portion of the ink supply tube is supported by the first support portion of the pivotable support member that is pivotable about the supporting point. Thus, the ink supply tube can follow the reciprocation of the carriage while the tube is prevented from sagging downward. In addition, since the pivotable support member is biased by the biasing device in the direction to reduce a diameter of the first curved portion of the ink supply tube, the curved portion is flexed in the direction to reduce the radius of curvature thereof. Thus, the swelling of the curved portion can be effectively restrained. The recording head mounted on the carriage may eject, at appropriate timings, the droplets of the ink based on the recording-related signal transmitted from, e.g., a control substrate. The first curved portion of the ink supply tube may have a generally U-shaped configuration in its plan view, and the ink tube may follow the reciprocation of the carriage while changing the radius of curvature of the U-shaped curved portion thereof. A biasing force of the biasing device is pre-selected at a value assuring that the reciprocation of the carriage is not adversely affected and the ink supply tube is not damaged.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

Figure 1:
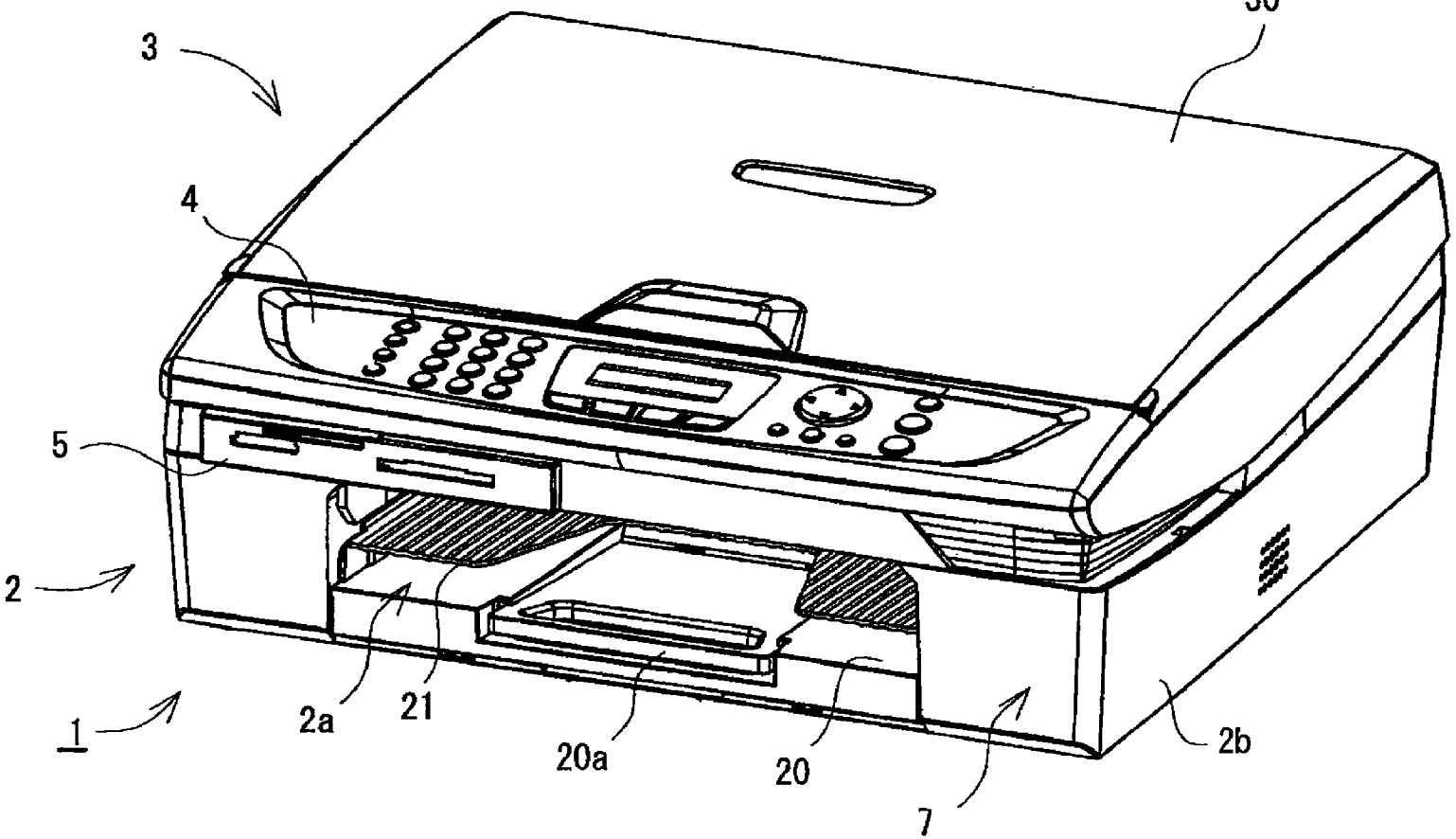
FIG. 1 is a perspective view of an external construction of a multi-function device (MFD) 1 including an image recording apparatus to which the present invention is applied.
Figure 2:
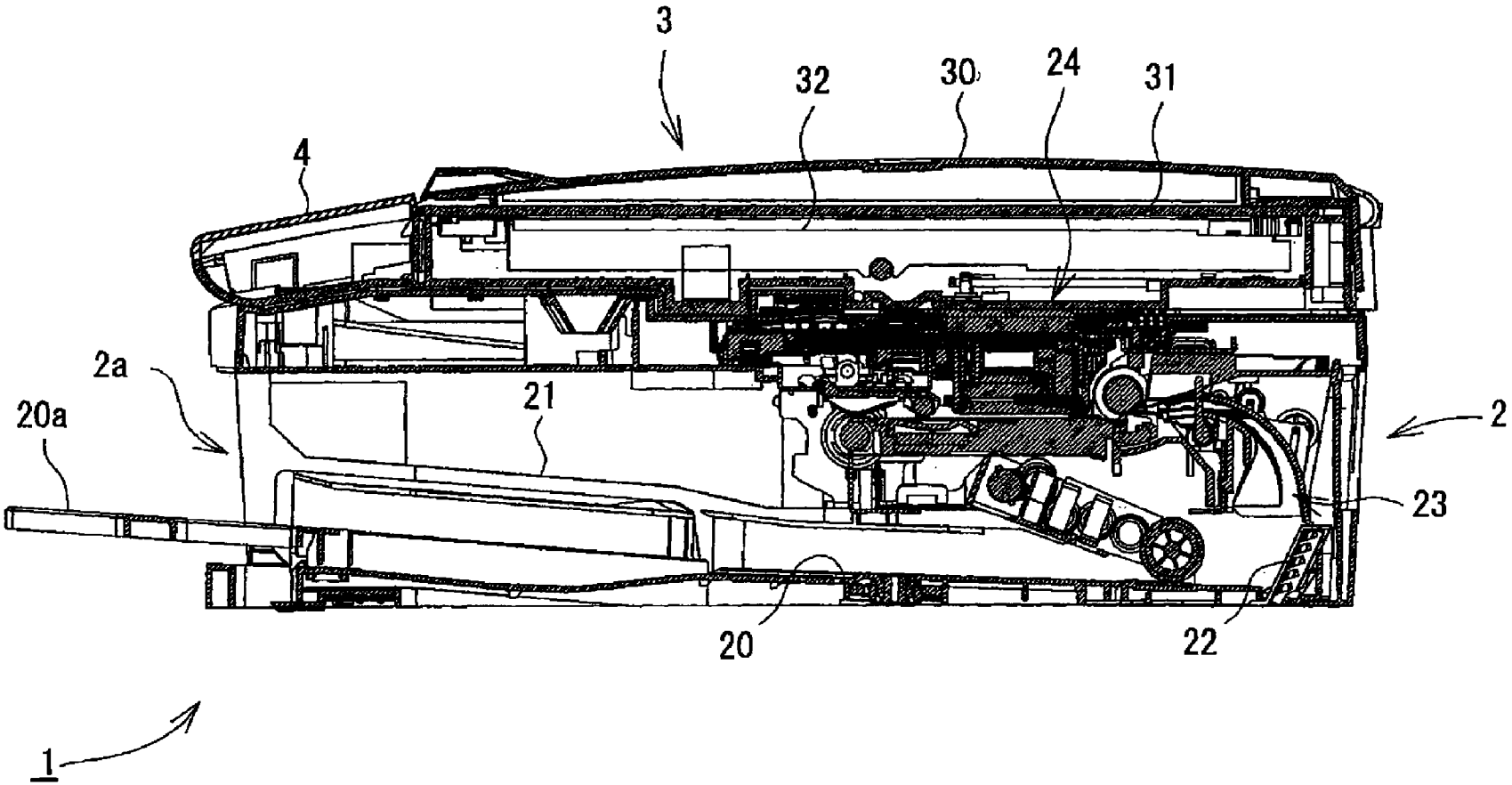
FIG. 2 is a cross-section view of an internal construction of the MFD 1.

FIG. 1 shows an external construction of a multi-function device (MFD) 1 to which the present invention is applied; and FIG. 2 shows an internal construction of the MFD 1. The MFD 1 includes, in a lower portion thereof, a printer portion 2, and additionally includes, in an upper portion thereof integral with the lower portion, a scanner portion 3. The MFD 1 has a printer function, a scanner function, a copier function, and a facsimile-machine function. In the present embodiment, the printer portion 2 corresponds to an image recording apparatus of the present invention, and accordingly the functions other than the printer function may be omitted. For example, the principle of the present invention is applicable to a single-function printer that has the printer function only, i.e., does not include the scanner portion 3 or does not have the scanner, copier, or facsimile-machine function.

When the MFD 1 functions as the printer, the printer portion 2 may be connected to an external information processor (not shown) such as a computer, so that the printer portion 2 may record, based on printing data (e.g., image data or document data) supplied from the computer, an image or a document on a recording medium such as a recording sheet. In addition, the MFD 1 may be connected to a digital camera, so that the printer portion 2 may record, based on image data supplied from the digital camera, an image on a recording sheet. Moreover, the MFD 1 may include a data-storage-medium receiving portion (e.g., a slot portion 5 shown in FIG. 1) that can receive each of various sorts of data-storage media, such as a memory card, so that the printer portion 2 may record, based on image data stored by the data-storage medium, an image on a recording sheet.

As shown in FIG. 1, the MFD 1 has an outer shape like a flat and elongate rectangular parallelepiped, that is, a length and a width of the MFD 1 are greater than a height thereof The MFD 1 has, in a front surface thereof, an opening 2*a*. A sheet-supply tray 20 and a sheet-discharge tray 21 can be inserted into the opening 2*a*, such that the two trays 20, 21 are aligned with each other in a vertical direction. The sheet-supply tray 20 is for accommodating recording sheets each as a recording medium, and can accommodate various sizes of recording sheets not larger than A-4 Size; such as A-4 Size, B-5 Size, or Postcard Size. The sheet-supply tray 20 includes a slide portion 20*a* that can be drawn out, as needed, to increase an area of a bottom surface of the tray 20, as shown in FIG. 2, so as to be able to accommodate Legal-Size recording sheets. As will be described in detail later, each of the recording sheets accommodated by the sheet-supply tray 20 is supplied to an image recording unit 24 of the printer portion 2, so that a desired image is recorded thereon. Each recording sheet on which an image has been recorded is discharged onto the sheet-discharge tray 21.

The scanner portion 3, provided in the upper portion of the MFD 1, is constituted by a so-called flat-bed scanner. As shown in FIGS. 1 and 2, the scanner portion 3 includes a document cover 30 that functions as a top plate of the MFD 1 and can be freely opened and closed. Under the document cover 30, there are provided a platen glass 31 and an image scanner 32. The platen glass 31 is for supporting an original document placed thereon. The image scanner 32 is provided below the platen glass 30, such that the scanner 32 is reciprocateable in a lengthwise direction of the MFD 1 (.e., a direction perpendicular to the drawing sheet of FIG. 2) so as to read an original image on the original document. A main scanning direction of the image sensor 32 is parallel to a widthwise direction of the MFD 1 (i.e., leftward and rightward directions in FIG. 2).

The MFD 1 has, in a front and upper portion thereof, an operation panel 4 that is manually operable by a user for operating the printer portion 2 and the scanner portion 3. The operation panel 4 includes various operation keys and a liquid-crystal display (LCD). The MFD 1 operates according to commands inputted through the operation panel 4. In the case where the MFD 1 is connected to the external computer, the MFD 1 may operate according to commands sent from the computer via a printer driver or a scanner driver. The MFD 1 has, in an upper and left portion of the front surface thereof, the slot portion 5 into which each of various small-size memory cards each as a data-storage medium can be inserted. When the user operates the operation panel 4 in an appropriate manner, image data stored by the small-size memory card inserted in the slot portion 5 are read out, so that the LCD of the panel 4 displays images represented by the image data. In addition, the printer portion 2 can be controlled to record, on a recording sheet or sheets, an image or images that is or are selected, through the operation of the keys of the panel 4, from the images displayed by the LCD.

Hereinafter, the internal construction of the MFD 1, in particular, the printer portion 2 will be described by reference to FIGS. 2 through 14. As shown in FIG. 2, the sheet-supply tray 20 is provided in a bottom portion of the MFD 1. On a rear side of the sheet-supply tray 20, i.e., on a right-hand side of the same 20 in FIG. 2, there is provided a sheet-separate inclined plate 22 that separates each one (i.e., an uppermost) recording sheet from the remaining recording sheets accommodated by the sheet-supply tray 20, and guides the each recording sheet in an upward direction. A sheet-feed path 23 first extends upward from the sheet-separate inclined plate 22, and then curves leftward, i.e., frontward of the MFD 1. Then, the sheet-feed path 23 reaches the sheet-discharge tray 21 via the image recording unit 24. Thus, each of the recording sheets accommodated by the sheet-supply tray 20 is fed along the sheet-feed path 23 including a U-turn portion where a direction of feeding of the recording sheet is changed from the rearward direction to the frontward direction, and eventually reaches the image recording unit 24. After the image recording unit 24 records an image or images on the recording sheet being fed along the sheet-feed path 23, the recording sheet is discharged onto the sheet-discharge tray 21.

Figure 3:
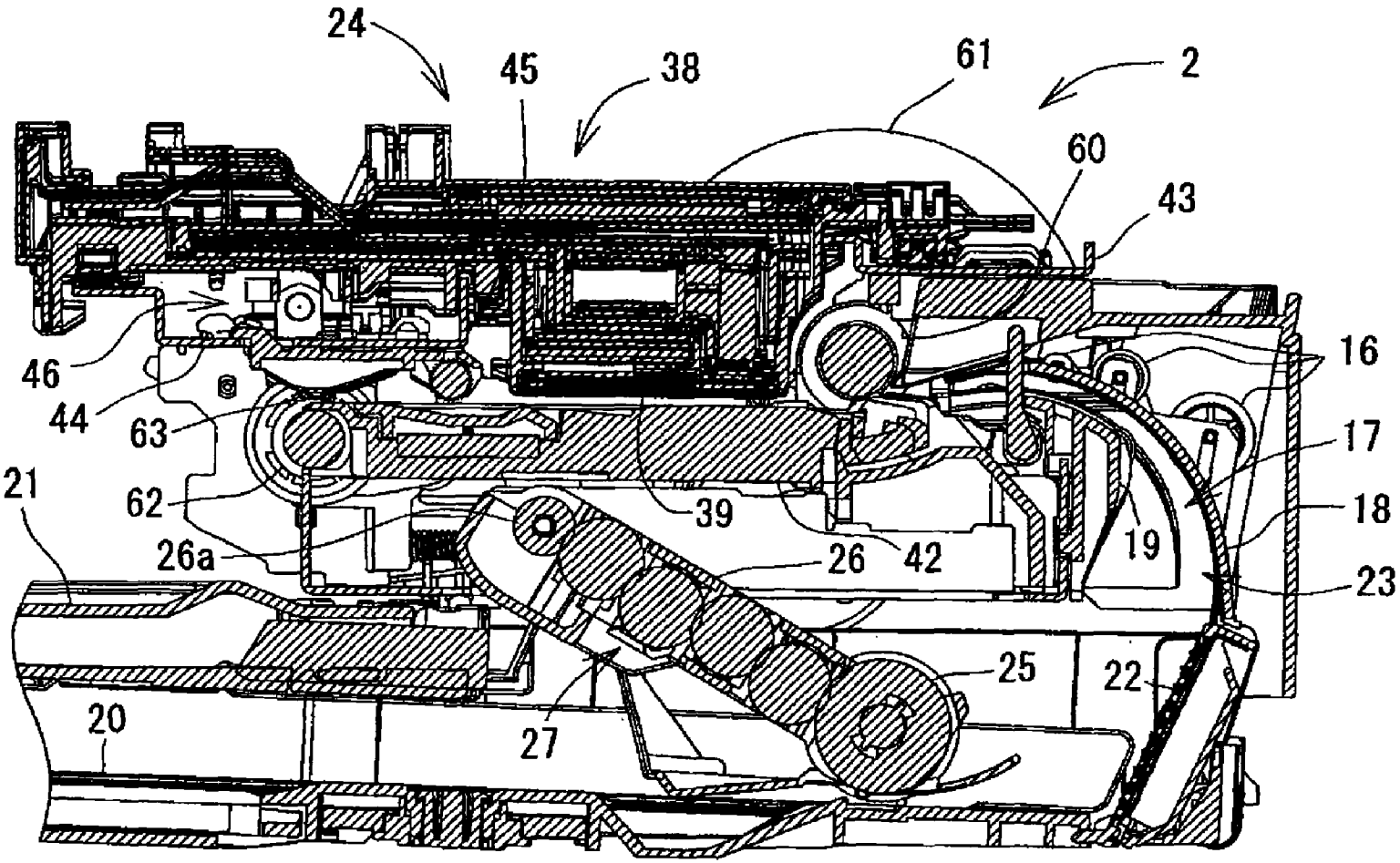
FIG. 3 is an enlarged cross-section view of a printer portion 2 of the MFD 1.

As shown in FIG. 3, a sheet-supply roller 25 is provided-above the sheet-supply tray 20, and supplies, from the tray 20, the recording sheets one by one into the sheet-feed path 23. The sheet-supply roller 25 is rotatably supported by a lower end portion of a sheet-supply arm 26 that is pivotable downward to contact the tray 20, and upward to move away from the same 20. The sheet-supply roller 25 is connected to a line-feed (LF) motor 71 (FIG. 7) via a driving-force transmission device 27 including a plurality of gears meshed with each other. When the LF motor 71 is driven or rotated, the driving force of the motor 71 is transmitted to the sheet-supply roller 25, so that the roller 25 is driven or rotated and sends out each recording sheet to the sheet-feed path 23.

The sheet-supply arm 26 is supported by an axis member 26*a*, such that the arm 26 is pivotable about the axis member 26*a*. Thus, the sheet-supply arm 26 is swingable upward and downward about the axis member 26*a*. As shown in FIG. 3, in a state in which the sheet-supply tray 20 is attached to the MFD 1, the sheet-supply arm 26 is biased downward, owing to its self weight and/or a spring (not shown), toward the tray 20. On the other hand, when the tray 20 is attached to, or detached from, the MFD 1, the arm 26 is retracted to its upper dead position. When the sheet-supply arm 26 is swung downward, the sheet-supply roller 25, rotatably supported by the lower end of the arm 26, is pressed on the uppermost one of the recording sheets stacked in the sheet-supply tray 20 and, if the roller 25 is rotated, a friction force produced between an outer circumferential surface of the roller 25 and an upper surface of the uppermost recording sheet sends out the recording sheet toward the sheet-separate inclined plate 22. A leading end of the recording sheet engages the inclined plate 22, and is deflected by the same 22 upward into the sheet-feed path 23. When the sheet-supply roller 25 sends out the uppermost recording sheet, another or additional recording sheet underlying the uppermost one may be sent out together with the uppermost one because of friction and/or static electricity. However, any further movement of the additional sheet can be prevented because the additional sheet is engaged with the inclined plate 22.

Except for a portion of the sheet-feed path 23 where the image recording unit 24 is provided, the path 23 is defined by an outer guide surface and an inner guide surface that are opposed to each other and are distant from each other by an appropriate distance. For example, a curved portion 17 of the sheet-feed path 23 that is located in a rear end portion of the MFD 1 is constituted by an outer guide member 18 and an inner guide member 19 that are each fixed to a main frame 2*b* (i.e., a portion of a housing) of the MFD 1. In the curved portion 17 of the sheet-feed path 23, sheet-feed rollers 16 are provided such that the sheet-feed rollers 16 are freely rotatable about respective-axis lines parallel to a widthwise direction of the path 23, i.e., the direction perpendicular to the drawing sheet of FIG. 3. More specifically described, the sheet-feed rollers 16 are provided such that the rollers 16 are exposed in the outer guide surface. Since the sheet-feed rollers 16 are provided in the curved portion 17 of the sheet-feed path 23, the recording sheet can be smoothly fed while being guided by the guide surfaces of the curved portion 17.

As shown in FIG. 3, the image recording unit 24 is provided in a midway portion of the sheet-feed path 23. The image recording unit 24 includes an ink-jet recording head 39, and a carriage 38 that carries the recording head 39 and reciprocates in opposite directions parallel to a main scanning direction. A platen 42 is opposed to the recording head 39. Independent of the recording head 39, four ink cartridges (not shown) are provided in the MFD 1, for supplying, to the head 39, four sorts of inks, i.e., a black ink (Bk), a yellow ink (Y), a magenta ink (M), and a cyan ink (C) via respective ink tubes 41 (FIG. 4) each as an ink supply tube. While the carriage 38 is reciprocated, the recording head 39 ejects, from four arrays of nozzles 53 (FIG. 5) thereof, fine droplets of those inks toward each recording sheet being temporarily stopped on the platen 42. Thus, an image or images is or are recorded on the recording sheet.

Figure 4:
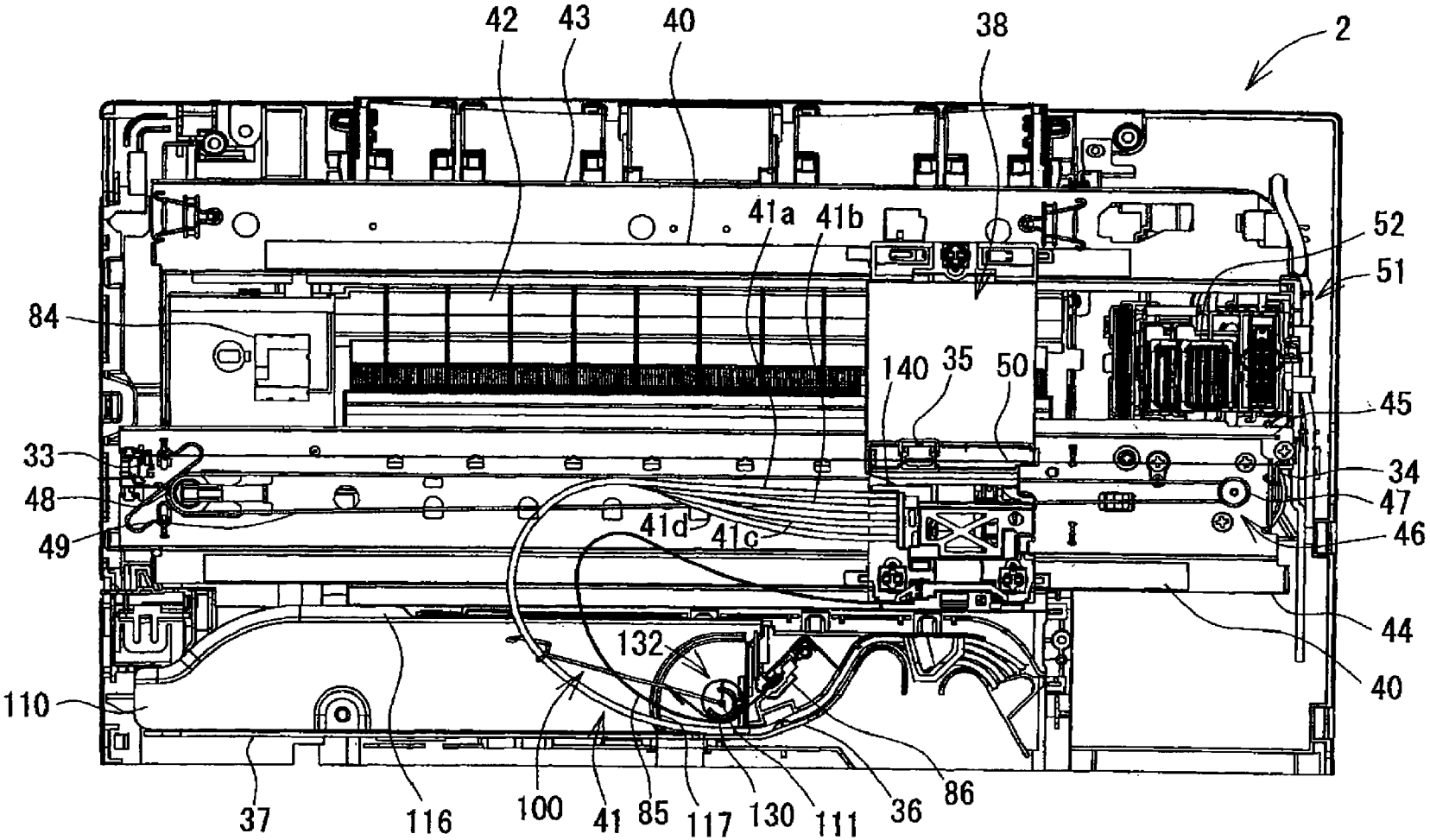
FIG. 4 is a plan view of the printer portion 2.

FIG. 4 shows a major portion of the printer portion 2, i.e., a central portion and a rear end portion of the same 2. Each recording sheet is fed in a sheet-feed direction from top to bottom in FIG. 4. Above the sheet-feed path 23, there are provided two guide rails 43, 44 that are spaced from each other by an appropriate distance in the sheet-feed direction and that each extend in a direction perpendicular to the sheet-feed direction, i.e., in leftward and rightward directions in FIG. 4. The two guide rails 43, 44 provide a portion of the main frame as a portion of the box-like housing 2b of the printer portion 2 that supports the various elements of the same 2. The carriage 38 bridges the two guide rails 43, 44, such that the carriage 38 is slideable in the opposite directions perpendicular to the sheet-feed direction. Since the two guide rails 43, 44 are arranged in the sheet-feed direction and along a horizontal plane, a height of the printer portion 2 can be reduced and accordingly the MFD 1 can be constructed to have the considerably flat shape.

The first guide rail 43 located on an upstream side of the second guide rail 44 as seen in the sheet-feed direction has a flat shape whose length as measured in a widthwise direction of the sheet-feed path 23 (.e., the leftward and rightward directions in FIG. 4) is greater than a movement range in which the carriage 38 reciprocates. A low-friction tape 40 is adhered to an upper surface of the first guide rail 43, i.e., more specifically described, along a downstream-side edge portion thereof in the sheet-feed direction. The low-friction tape 40 is for lowering the friction produced when the carriage 38 slides on the first guide rail 43. An upstream-side end portion of the carriage 38 is placed on the low-friction tape 40, and is slid in a lengthwise direction of the tape 40.

The second guide rail 44 located on a downstream side of the first guide rail 43 in the sheet-feed direction also has a flat shape whose length as measured in the widthwise direction of the sheet-feed path 23 is substantially equal to that of the first guide rail 43. Another low-friction tape 40 is adhered to an upper surface of the second guide rail 44, i.e., more specifically described, along a downstream-side edge portion thereof in the sheet-feed direction. This second low-friction tape 40 is for lowering the friction produced when the carriage 38 slides on the second guide rail 44. A downstream-side end portion of the carriage 38 is placed on the second low-friction tape 40, and is slid in a lengthwise direction of the tape 40. The second guide rail 44 has, as an upstream-side end portion thereof, an upright wall 45 that extends upward at a substantially right angle from a horizontal bottom portion thereof The carriage 38 has a holding portion (e.g., a pair of rollers) that holds the upright wall 45 such that the carriage 38 is slideable along the wall 45. Thus, the carriage 38 is accurately positioned relative to the guide rails 43, 44 with respect to the sheet-feed direction, such that the carriage 38 is slideable in directions that intersect the sheet-feed direction, e.g., the opposite directions that are perpendicular to the sheet-feed direction. In short, the carriage 38 is supported by the two guide rails 43, 44 such that the carriage 38 is slideable thereon, i.e., is reciprocateable in the opposite directions intersecting the sheet-feed direction while being guided by the upright wall 45 of the second guide rail 44. Although not shown in FIG. 3 or FIG. 4, the upright wall 45 is coated with a lubricant (e.g., grease) so as to cause the carriage 38 to slide smoothly along the wall 45.

A carriage driving device 46 is provided on the downstream-side guide rail 44. The carriage driving device 46 includes a drive pulley 47 and a driven pulley 48 that are respectively provided around widthwise opposite ends of the sheet-feed path 23, and an endless, annular timing belt 49 that is wound on the two pulleys 47, 48 and has teeth on an inner surface thereof. An axis member of the drive pulley 47 is connected to a carriage (CR) motor 73 (FIG. 7) so as to receive a driving force therefrom. When the drive pulley 47 is rotated by the CR motor 73, the timing belt 49 is circulated. The endless annular timing belt 49 may be replaced with such a belt that has opposite ends permanently fixed to the carriage 38.

Figure 7:
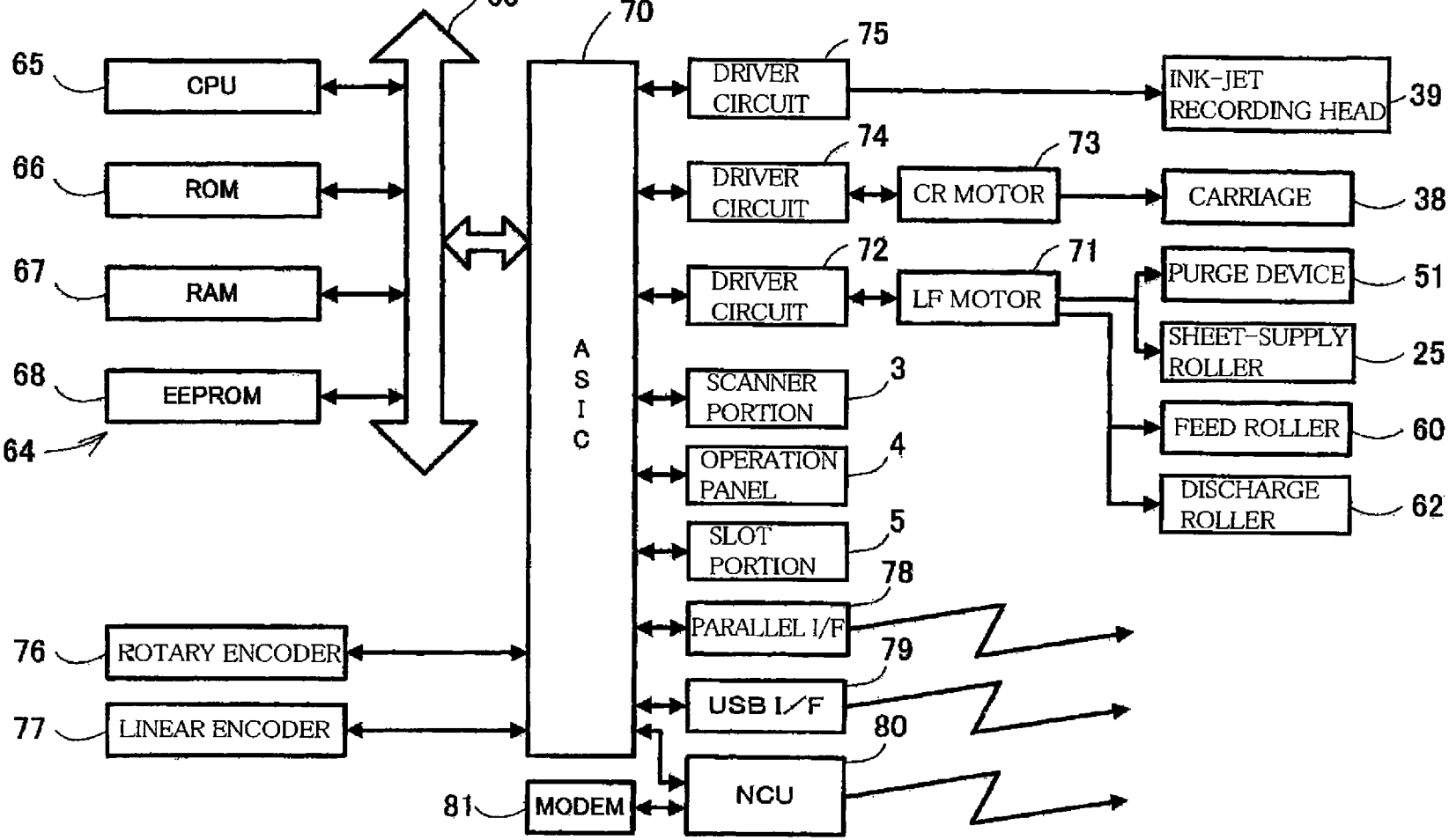
FIG. 7 is a diagrammatic view of a control portion 64 of the MFD 1.

A portion of the timing belt 49 is fixed to a bottom portion of the carriage 38. Therefore, when the timing belt 49 is circulated, the carriage 38 is reciprocated on the two guide rails 43, 44 while being guided by the upright wall 45. Since the inkjet recording head 39 is mounted on the carriage 38, the recording head 39 can be reciprocated in the widthwise direction of the sheet-feed path 23, i.e., the main scanning direction. The downstream-side guide rail 44 is equipped with an encoder strip 50 -as a portion of a linear encoder 77 (FIG. 7). The encoder strip 50 is constituted by a belt-like transparent sheet formed of a resin. Opposite end portions of the guide rail 44 in the reciprocation direction of the carriage 38 are equipped with respective support portions 33, 34 that each extend upward from the upper surface of the guide rail 44. Opposite end portions of the encoder strip 50 are held by the two support portions 33, 34, respectively, such that the strip 50 horizontally extends along the upright wall 45. Although not shown in FIG. 4, one of the two support portions 33, 34 includes a sheet-shaped spring that holds one of the opposite end portions of the encoder strip 50. This sheet-shaped spring applies a tension to the encoder strip 50 in a lengthwise direction thereof and thereby prevents the strip 50 from being loosened. On the other hand, when an external force is applied to the encoder strip 50, the sheet spring is elastically deformed to allow the strip 50 to flex.

The encoder strip 50 has an optical pattern including a plurality of light transmitting portions that each transmit light, and a plurality of light blocking portions that each blocks light and are alternate with the light transmitting portions at a predetermined pitch in the lengthwise direction of the strip 50. A transmission-type optical sensor 35 is provided, on an upper surface of the carriage 38, at a position corresponding to the encoder strip 50. The optical sensor 35 is reciprocated with the carriage 38 along the encoder strip 50, while detecting the optical pattern of the strip 50. The recording head 39 is equipped with a head control substrate, not shown, that controls an ink ejecting operation of the head 39. The head control substrate outputs pulse signals based on detection signals supplied from the optical sensor 35. Based on the pulse signals, a position and a velocity of the carriage 38 are detected or recognized and the reciprocation of the carriage 38 is controlled. Since the head control substrate is located under a top cover of the carriage 38, the substrate is not shown in FIG. 4.

As shown in FIGS. 3 and 4, the platen 42 is provided below the sheet-feed path 23, such that the plate 42 is opposed to the recording head 39. Each recording sheet passes through a central portion of the reciprocation range of the carriage 38, and the platen 42 extends over a range corresponding to a central portion of the reciprocation range. A length of the platen 42 is sufficiently greater than the greatest one of respective widths of the various sorts of recording sheets that can be fed through the sheet-feed path 23. Therefore, widthwise opposite ends of each sort of recording sheet can pass over the platen 42.

As shown in FIG. 4, maintenance devices including a purge device 51 and a waste-ink tray 84 are provided in ranges where each recording sheet does not pass, i.e., ranges outside an image-record range where the recording head 39 records images on recording sheets. The purge device 51 is for removing, by application of suction, air bubbles and/or foreign matters from the ink ejection nozzles 53 (FIG. 5) of the recording head 39. The purge device 51 includes a cap member 52 for covering the nozzles 53 of the recording head 39; a pump device (not shown) that can be coupled with the nozzles 53 via the cap member 52; and a moving device (not shown) that moves the cap member 52 toward and away from the nozzles 53. Since the pump device and the moving device are provided below the guide rail 44, those devices are not shown in FIG. 4. When the air bubbles or the like are removed, i.e., sucked from the recording head 39, first, the carriage 38 is moved to a capping position where the head 39 is aligned with the cap member 52. In this state, the moving device moves the cap member 52 upward so as to air-tightly contact the lower surface of the recording head 39 and thereby close the nozzles 53. Then, the pump device supplies a negative pressure to the cap member 52 so as to remove the air bubbles and/or the foreign matters together with some amount of ink from the nozzles 53.

The waste-ink tray 84 is for collecting the ink ejected by the recording head 39 when the head 39 performs an idling operation, i.e., a so-called "flushing" operation. The waste-ink tray 84 is provided, on an upper surface of the platen 42, at a position within the reciprocation range of the carriage 38 but outside the image-record range of the recording head 39. The waste-ink tray 84 is equipped with a woven felt that absorbs and holds the ink flushed by the recording head 39. Those maintenance devices cooperate with each other to perform maintenance operations on the recording head 39; such as removal of air bubbles and/or mixed inks, or prevention of drying of inks.

As shown in FIG. 1, the housing 2*b* of the printer portion 2 has, in a front wall thereof, a door 7 that can be opened and closed. When the door 7 is opened, an ink-cartridge accommodating portion, not shown, is exposed through the front wall of the housing 2*b*, so as to be able to accommodate the four ink cartridges that store the cyan ink, the magenta ink, the yellow ink, and the black ink, respectively. Although not shown, the ink-cartridge accommodating portion has four spaces to accommodate the four ink cartridges, respectively. As shown in FIG. 4, the four ink tubes 41 (41*a*, 41*b*, 41*c*, 41*d*) corresponding to the four inks, respectively, connect between the ink-cartridge accommodating portion and the carriage 38, such that the carriage 38 can reciprocate in the main scanning direction. Respective end portions of the four ink tubes 41 that correspond to the carriage 38 are connected to a tube connection portion 140 (described later) of the carriage 38. The recording head 39 mounted on the carriage 38 is supplied with the four inks from the four ink cartridges accommodated by the ink-cartridge accommodating portion, via the four ink tubes 4, respectively. The combination of the ink cartridges and the ink-cartridge accommodating portion may be of any type known in the art, so long as it can cooperate with the ink tubes 41 to supply the inks, and accordingly the construction thereof is not described in detail here.

Each of the ink tubes 41 is formed of a synthetic resin to be straight in its original shape. Each ink tube 41 has an appropriate degree of rigidity (.e., flexural rigidity) to keep its straight shape. On the other hand, each ink tube 41 has such a flexibility that when an external force is applied to the tube 41, the tube 41 is flexed, and additionally has such an elasticity that when the external force is removed, the tube 41 is returned to its original straight shape. Therefore, as the carriage 38 moves, each ink tube 41 changes its shape to follow the movement of the carriage 38. As shown in FIG. 4, first, each ink tube 41 is led, in the main scanning direction, from the cartridge-accommodating portion to around a central portion of the housing 2*b* of the printer portion 2 where a portion of the tube 41 is fixed by a first fixing clip 36 to a restrictor wall 37 as a portion of the housing 2*b* of the printer portion 2. However, an intermediate portion of each ink tube 41 that is located between the fixing clip 36 and the carriage 38 is not fixed to anything, so that the intermediate portion of the tube 41 may change its shape to follow the movement of the carriage 38. In FIG. 4, a base portion of each ink tube 41 that is located between the first fixing clip 36 and the cartridge accommodating portion (not shown) is partly cut away, and an end portion of the tube 41 that is connected to the cartridge accommodating portion is not shown.

As shown in FIG. 4, each ink tube 41 (41*a*, 41*b*, 41*c*, 41*d*) follows the movement of the carriage 38, while the above-indicated intermediate portion of the each tube 41, located between the first fixing clip 36 and the carriage 38, forms a curved portion, more specifically described, a generally U-shaped curved portion in its plan view. The generally U-shaped curved portion is convex in one of the opposite directions parallel to the main scanning direction. The four ink tubes 41 are connected to the tube connection portion 140 of the carriage 38, such that the four tubes 41 are arranged in the sheet-feed direction along a horizontal plane and such that the respective end portions of the four tubes 41, connected to the carriage 38, extend in the main scanning direction (i.e., the reciprocation direction) of the carriage 38. A construction of the tube connection portion 140 will be described in detail later.

Respective midway portions of the four ink tubes 41 that are fixed by the first fixing clip 36 to the housing 2*b* of the printer portion 2 are arranged such that those midway portions are superposed on each other in a vertical direction, i.e., a direction perpendicular the drawing sheet of FIG. 4. The first fixing clip 36 is constituted by a member having a U-shaped cross section that opens upward, and the four ink tubes 41 are inserted, one by one, into the clip 36 through the upper opening thereof so that the four tubes 41 are stacked on each other in the order of insertion in the vertical direction. Thus, the respective midway portions of the four ink tubes 41 are held with each other by the first fixing clip 36. Therefore, as seen in a direction from the first fixing clip 38 toward the carriage 38, the respective intermediate portions of the four ink tubes 41, arranged in the vertical direction at the clip 36, are gradually twisted into the horizontal arrangement at the tube connection portion 140 of the carriage 38, while the respective intermediate portions of the four ink tubes 41 as a whole form a generally U-shaped curve in their plan view.

Respective lengths of the respective intermediate portions of the four ink tubes 41, located between the fixing clip 36 and the carriage 38, are substantially equal to each other. A most upstream one 41*a* of the four ink tubes 41*a*, 41*b*, 41*c*, 41*d* as seen in the sheet-feed direction at the carriage 38 is an uppermost one of the four tubes 41*a*, 41*b*, 41*c*, 41*d* as seen in the vertical direction at the fixing clip 36. The ink tube 41*b* adjacent to the most upstream ink tube 41*a* at the carriage 38 is adjacent to the uppermost ink tube 41*a* at the fixing clip 36. This is repeated, and eventually the four ink tubes 41*a*, 41*b*, 41*c*, 41*d* are arranged, at the tube connection portion 140, in the order of description in the sheet-feed direction, i.e., in the direction from the upstream side toward the downstream side, and are arranged, at the fixing clip 36, in the order of description in the vertical direction, i.e., in the direction from the upper side toward the lower side. As described above, the respective entire lengths of the four ink tubes 41 are designed to be substantially equal to each other. Therefore, the respective intermediate portions of the four ink tubes 41 are curved such that respective centers of the respective U-shaped curves of those intermediate portions are somewhat offset from each other in the sheet-feed direction, owing to the horizontal arrangement of the four tubes 41 at the carriage 38. Thus, the respective U-shaped curved portions of the four ink tubes 41 are arranged in an oblique direction from the upper side toward the lower side, so that when the intermediate portions of the four tubes 41 follow the movement of the carriage 38 while changing their shapes, the interference of the intermediate portions with each other is effectively restrained. In the present embodiment, the four ink tubes 41 are employed. However, in the case where an increased number of ink tubes are employed, those ink tubes may be arranged in the same manner as described above. The total number of ink tubes employed may be changed, as needed, depending upon the total number of inks used. For example, in the case where the present invention is applied to a monochromatic-image recording apparatus wherein only a black ink is used, only one ink tube is employed.

The MFD 1 operates under control of a control portion 64 (FIG. 7) that is constituted by a main substrate. The control portion 64 or the main substrate transmits a recording command signal or the like to the head control substrate of the recording head 39 via a flat cable 85 as an electrically conductive cable. The main substrate is provided in a front end portion of the MFD 1, and is not shown in FIG. 4. The flat cable 85 has a thin, belt-like shape, and includes a plurality of electrically conductive lines each of which transmits an electric signal; and a synthetic-resin-based film, such as a polyester-based film, that covers or contains the electrically conductive lines to electrically insulate the same. The flat cable 85 electrically connect between the main substrate and the head control substrate both of which are not shown.

The flat cable 85 has such a flexibility that when the carriage 38 reciprocates in the main scanning direction, the cable 85 flexes and follows the movement of the carriage 38 in a state in which opposite major surfaces of the thin belt-like flat cable 85 are vertical, that is, a perpendicular to those major surfaces is horizontal. As shown in FIG. 4, an end portion of the flat cable 85 is fixed by a second fixing clip 86 to the housing 2*b* of the printer portion 2, and the other end portion of the same 85 is fixed to the carriage 38. An intermediate portion of the flat cable 85 that is located between the second axing clip 86 and the carriage 38 forms a curved portion, in particular, a generally U-shaped curved portion in its plan view. The generally U-shaped curved portion of the flat cable 85 is convex in the same direction as the direction in which the respective generally U-shaped curved portions of the four ink tubes 41 are convex. The flat cable 85 is lead from the carriage 38 in the same direction as the direction in which the four ink tubes 41 are extended from the carriage 38, i.e., the main scanning direction in which the carriage 38 reciprocates.

As described above, the other end portion of the flat cable 85, fixed to the carriage 38, is electrically connected to the head control substrate (not shown) mounted on the carriage 38. The one end portion of the flat cable 85, fixed to the second fixing clip 86, is further extended and is electrically connected to the main substrate. The generally U-shaped curved portion of the flat cable 85 is not fixed to anything, so that like the ink tubes 41, the intermediate portion of the flat cable 85 may follow the reciprocation of the carriage 38 while changing its shape. The ink tubes 41 and the flat cable 8 that follow the reciprocation of the carriage 38 while changing their shapes, are supported by a pivotable support member 100. A construction of the pivotable support member 100 and a construction of a supporting device that pivotally supports the pivotable support member 100 will be described in detail, later.

On a front side of the ink tubes 41 and the flat cable 85, there is provided a restrictor wall 37 that is elongate in the reciprocation direction of the carriage 38, i.e., the leftward and rightward directions in FIG. 4. The restrictor wall 37 has a vertical rear-side surface that abuts on the ink tubes 41 and is straight and elongate in the reciprocation direction of the carriage 38. The restrictor wall 37 is provided, between the first fixing clip 36 that fixes the ink tubes 41, and a left-hand side wall of the housing 2*b* of the printer portion 2, in the reciprocation direction in which the ink tubes 41 extend from the fixing clip 36. The restrictor wall 37 has such a height that assures that the wall 37 abuts on all the four ink tubes 41 arranged in the vertical direction in the fixing clip 36.

Figure 16:
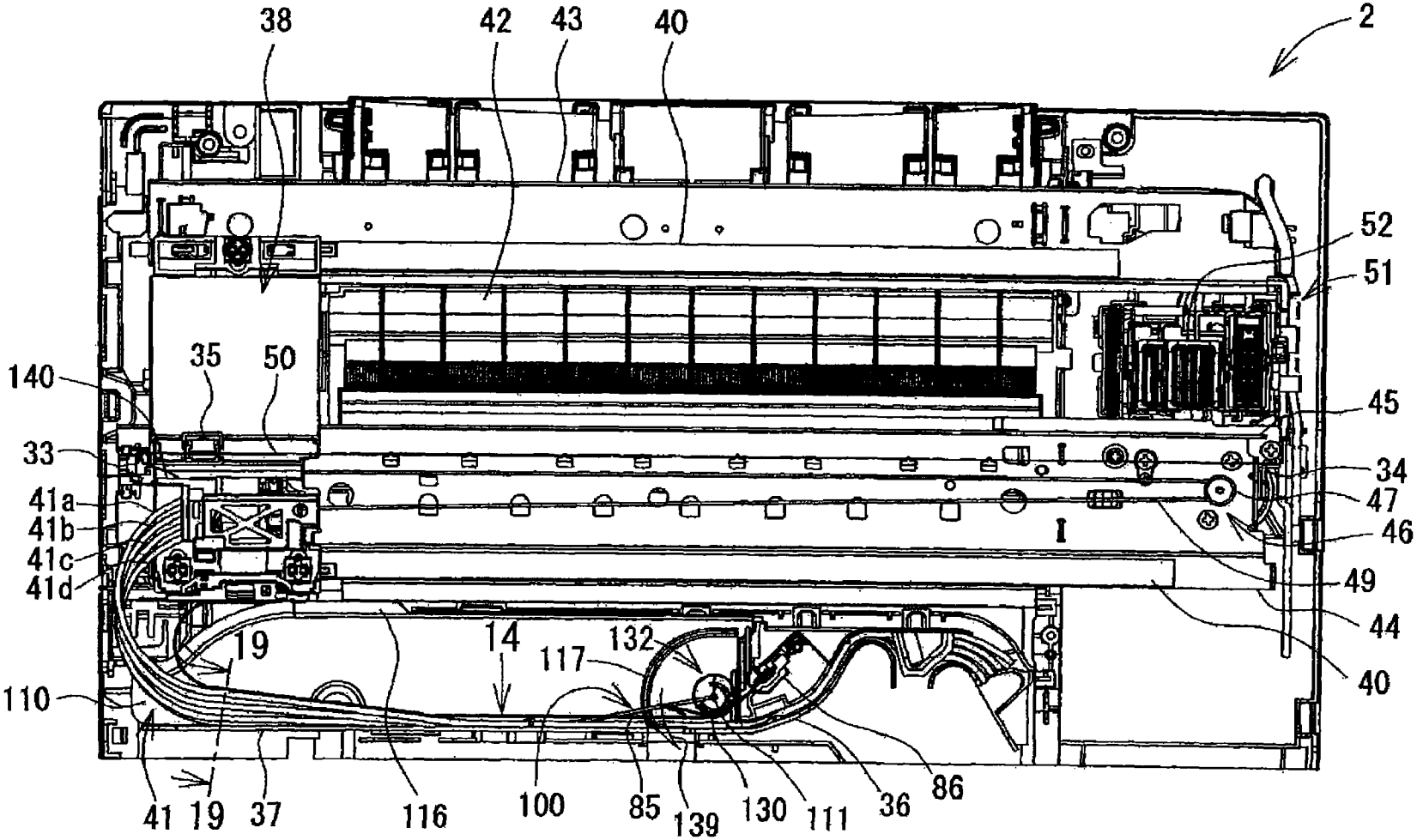
FIG. 16 is yet another plan view of the printer portion 2.

More specifically described, the four ink tubes 41 extend from the first fixing clip 36 along the restrictor wall 37, while abutting on the vertical rear-side surface of the wall 37. Thus, the four ink tubes 41 are effectively prevented from swelling in a frontward direction, i.e., a direction away from the carriage 38. In the state in which the four ink tubes 41 are in abutment on the restrictor wall 37 as shown in FIG. 16, respective portions of the four ink tubes 41 that are located between respective left-hand end portions of the respective curved portions thereof and the first fixing clip 36 maintain the same vertical arrangement as that of the four tubes 41 at the fixing clip 36. Therefore, the respective curved (i.e., generally U-shaped) portions of the four ink tubes 41 can surely maintain the desired oblique arrangement shown in FIG. 16.

The first fixing clip 36 is provided at a substantially middle position in the lengthwise direction of the MFD 1, and fixes the four ink tubes 41 such that the four tubes 41 extend in a direction having a component toward the restrictor wall 37. That is, the vertical rear-side surface of the restrictor wall 37 and the direction in which the four ink tubes 41 extend from the first fixing clip 36 cooperate with each other to contain, in a plan view, an angle smaller than 90 degrees, preferably, 45 degrees. As described above, each ink tube 41 has appropriate degrees of rigidity (flexural rigidity), flexibility, and elasticity. Therefore, if the four ink tubes 41 extend from the first fixing clip 36 with an appropriate angle relative to the restrictor wall 37, the four tubes 41 are pressed against the vertical surface of the restrictor wall 37. Thus, within the reciprocation range in which the carriage 38 reciprocates, a range in which the ink tubes 41 are restricted by the restrictor wall 37 increases and accordingly a range (.e., an area) in which the respective curved portions of the ink tubes 41 swell in the rearward direction, i.e., a direction toward the carriage 38 decreases.

The second fixing clip 86 is provided at a position that is substantially middle in the lengthwise direction of the MFD 1 and is nearer to the respective centers of the curved portions of the ink tubes 41 than the first fixing clip 36. The second fixing clip 86 fixes the flat cable 85 such that the cable 85 extends in a direction having a component toward the restrictor wall 37. That is, the vertical rear-side surface of the restrictor wall 37 and the direction in which the flat cable 85 extends from the second fixing clip 85 cooperate with each other to contain, in a plan view, an angle smaller than 90 degrees, preferably, 45 degrees. As described above, the flat cable 85 has not only an appropriate degree of flexibility but also an appropriate degree of rigidity (flexural rigidity). Therefore, if the flat cable 85 extends from the second fixing clip 86 with an appropriate angle relative to the restrictor wall 37, the cable 85 is pressed against the vertical surface of the restrictor wall 37, indirectly via the ink tubes 41. Thus, within the reciprocation range of the carriage 38, a range in which the flat cable 85 is restricted by the restrictor wall 37 increases and accordingly a range (i.e., an area) in which the curved portion of the flat cable 85 swells in the rearward direction, i.e., a direction toward the carriage 38 decreases. Whether the flat cable 85 is pressed against the restrictor wall 37, directly or indirectly, depends on a relative-positional relationship between the four ink tubes 41 and the flat cable 85. Therefore, in the case where the relative-positional relationship between the ink tubes 41 and the flat cable 85, employed in the present embodiment, is reversed, the flat cable 85 is directly pressed against the restrictor wall 37, and the ink tubes 41 are indirectly pressed against the restrictor wall 37 via the flat cable 85.

Figure 5:
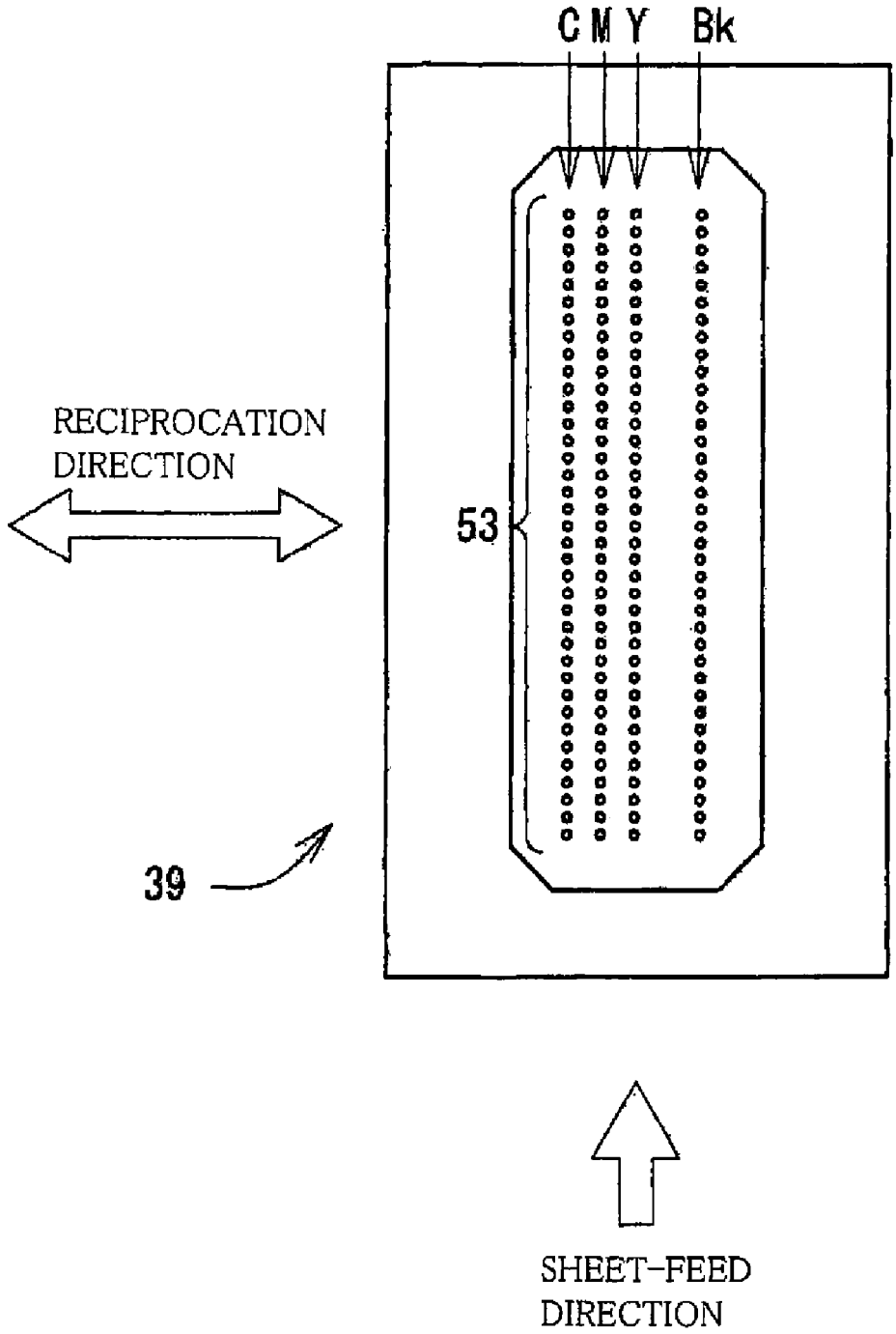
FIG. 5 is a bottom view of a lower surface of an ink-jet recording head 39 in which ink ejection nozzles 53 open.

FIG. 5 shows the lower surface (i.e., a so-called "nozzle" surface) of the recording head 39. As shown in the figure, the recording head 39 has, as viewed from left to right, an array of ink ejection nozzles 53 corresponding to the cyan ink (C), an array of ink ejection nozzles 53 corresponding to the magenta ink (M), an array of ink ejection nozzles 53 corresponding to the yellow ink (Y), and an array of ink ejection nozzles 53 corresponding to the black ink (Bk), such that the four nozzle arrays 53 are parallel to the sheet-feed direction perpendicular to the reciprocation direction of the carriage 38, and are arranged in the reciprocation direction. A pitch, and a total number, of the nozzles 53 belonging to each array are selected based on, e.g., a recording resolution at which images are recorded. In addition, a total number of the nozzle arrays may be changed depending upon a total number of the sorts of inks used.

Figure 6:
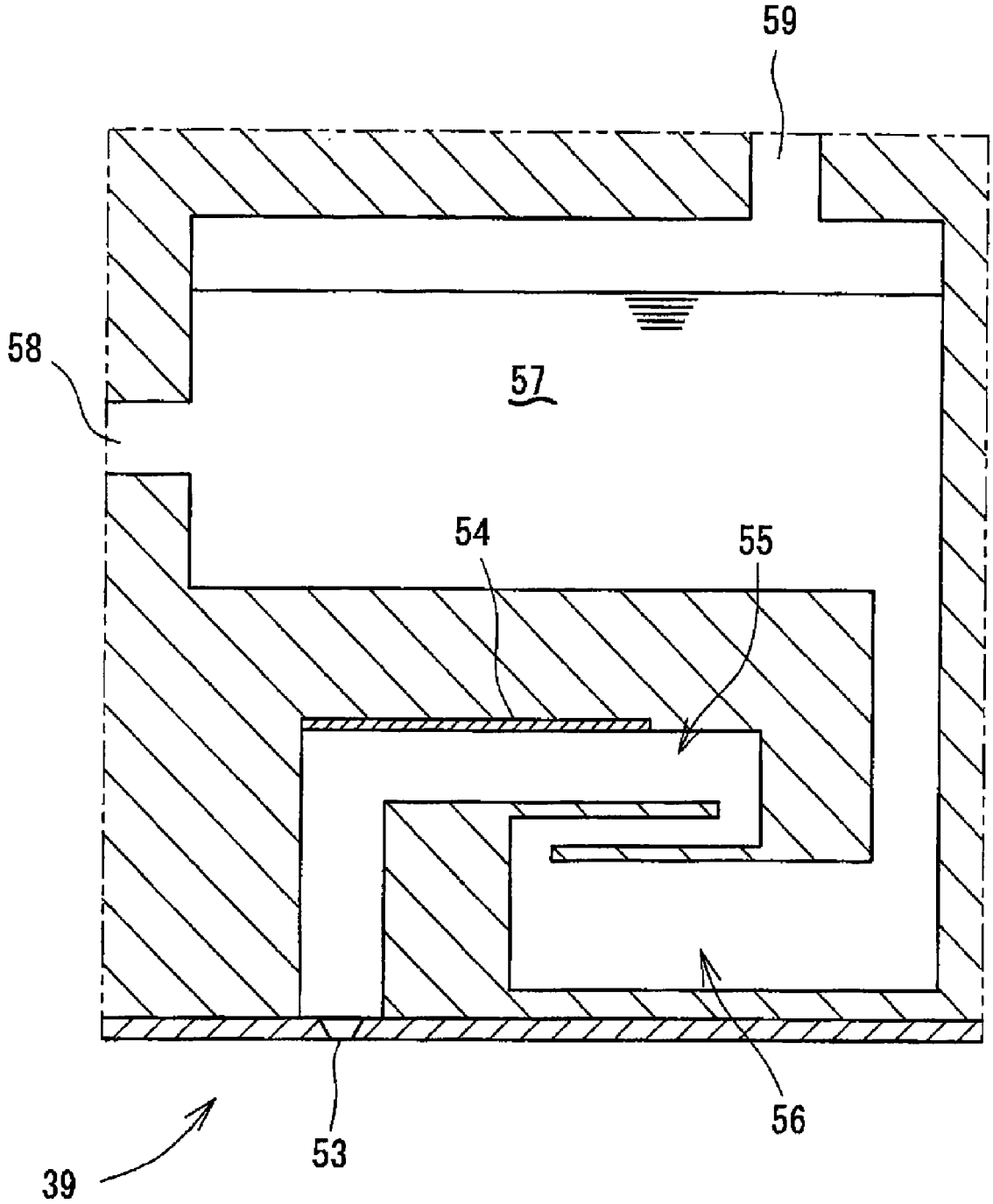
FIG. 6 is an illustrative cross-section view of the ink-jet recording head 39.

FIG. 6 shows an internal construction of the inkjet recording head 39. As shown in the figure, on an upstream side of each of the ink ejection nozzles 53 formed in the lower surface of the recording head 39, there is formed a cavity 55 that is equipped with a piezoelectric element 54. Upon application of an appropriate electric voltage to the piezoelectric element 54, the element 54 is deformed to decrease a volume of the cavity 55. Based on the change (decrease) of the volume of the cavity 55, a droplet of ink is ejected from the cavity 55 via the nozzle 53.

Each of the cavities 55 communicates with a corresponding one of the nozzles 53, and each array of cavities 55 communicates with a common manifold 56. More specifically described, four arrays of cavities 55 communicate with four manifolds 56, respectively, that temporarily hold the four sorts of inks C, M, Y, Bk, respectively. On an upstream side of each of the four manifolds 56, there is formed a buffer tank 57. That is, the four buffer tanks 57 temporarily accommodate the four inks C, M, Y, Bk, respectively. Each of the four buffer tanks 57 is supplied with a corresponding one of the four inks C, M, Y, Bk from a corresponding one of the four ink tubes 41*a*, 41*b*, 41*c*, 41*d* via a corresponding one of four ink-supply inlets 58. Since the inks C, M, Y, Bk are temporarily accommodated by the buffer tanks 57, air bubbles that have been produced in the ink tubes 41 or elsewhere are captured and are prevented from entering the manifolds 56 and the cavities 56. The air bubbles captured in the buffer tanks 57 are discharged or sucked by a pump device (not shown) via respective air-discharge outlets 59. On the other hand, the inks C, M, Y, Bk supplied from the buffer tanks 57 are distributed to the cavities 55 via the manifolds 56.

Thus, the inks C, M, Y, Bk supplied from the ink cartridges via the ink tubes 41*a*, 41*b*, 41*c*, 41*d* flow to the cavities 55 through respective ink channels including the buffer tanks 57 and the manifolds 56. The inks C, M, Y, Bk supplied through the ink channels are ejected in the form of fine droplets from the nozzles 53 upon deformation of the piezoelectric elements 54.

As shown in FIG. 3, on an upstream side of the image recording unit 24 along the sheet-feed path 23, there are provided a feed roller 60 and a pinch roller (not shown). Though, in the figure, the pinch roller is hidden by other elements and cannot be seen, the pinch roller is provided beneath the feed roller 60 such that the pinch roller is held in pressed contact with the feed roller 60. The feed roller 60 and the pinch roller cooperate with each other to pinch each recording sheet being fed along the sheet-feed path 23, and send the recording sheet onto an upper flat surface of the platen 42. On a downstream side of the image recording unit 24 along the sheet-feed path 23, there are provided a discharge roller 62 and a spur roller 63. The discharge roller 62 and the spur roller 63 cooperate with each other to pinch the recording sheet on which images have been recorded and send the recording sheet onto the sheet-discharge tray 21. The feed roller 60 and the discharge roller 62 are supplied with a driving force of the LF motor 71 (FIG. 7), and are intermittently driven or rotated by incremental amounts or angles each corresponding to a distance between two adjacent lines to be recorded on the recording sheet. The respective rotations of the feed roller 60 and the discharge roller 62 are synchronized with each other. The feed roller 60 is equipped with a rotary encoder 76 (FIG. 7) including an encoder disc 61 that is rotated with the feed roller 60, and an optical pattern of the encoder disc 61 is read or detected by an optical sensor (not shown). Based on detection signals supplied from the optical sensor, the respective rotations of the feed roller 60 and the discharge roller 62 are controlled.

Since the spur roller 63 is pressed on the recording sheet having the images thereon, an outer circumferential surface of the spur roller 63 has a plurality of projections so as not to deteriorate the images recorded on the sheet. The spur roller 63 is movable or slideable toward and away from the discharge roller 62, and is biased by a coil spring (not shown) so as to be pressed on the same 62. When the recording sheet reaches a pinching or nipping point of the combination of the discharge roller 62 and the spur roller 63, the spur roller 63 is forcedly retracted from the discharge roller 62 against the biasing force of the coil spring, by a distance corresponding to the thickness of the recording sheet, so that the spur roller 63 cooperates with the discharge roller 62 to nip the recording sheet. Thus, the rotation force of the discharge roller 62 is reliably transmitted to the recording sheet. The above-indicated pinch roller paired with the feed roller 60 has a construction similar to that of the spur roller 63, and cooperates with the feed roller 60 to nip the recording sheet and reliably transmit the rotation force to the same.

FIG. 7 diagrammatically shows a construction of the control portion 64 of the MFD 1. The control portion 64 controls the operation of the MFD 1 as a whole, including the respective operations of the printer portion 3 and the scanner portion 2, and is constituted by the main substrate (not shown) to which the flat cable 85 is connected. Since, however, a portion of the control portion 64 that is related to the scanner portion 2 is not relevant to the present invention, the detailed description thereof is omitted. As shown in the figure, the control portion 64 is essentially constituted by a microcomputer including a CPU (central processing unit) 65, a ROM (read only memory) 66, a RAM (random access memory) 67, and an EEPROM (electrically erasable and programmable ROM) 68. The control portion 64 is connected via a bus 69 to an ASIC (application specific integrated circuit) 70.

The ROM 66 stores, e.g., control programs used to control the various operations of the MFD 1. The RAM 67 is used as a memory area or an operation area that temporarily stores various sorts of data needed for the CPU 65 to implement the above-indicated control programs. The EEPROM 68 stores various pre-set data and flags that should be kept after the MFD 1 is powered off.

The ASIC 70 produces, according to a command supplied from the CPU 65, a phase drive signal to drive the LF motor 71, and supplies the signal to a driver circuit 72 to drive the LF motor 71 and thereby control the rotation thereof The driver circuit 72 drives the LF motor 71 that is connected to the sheet-supply roller 25, the feed roller 60, the discharge roller 62, and the purge device 51. Based on the output signal supplied from the ASIC 70, the driver circuit 72 produces an electric signal to drive the LF motor 71. In response to the electric signal, the LF motor 71 is rotated and the rotation force of the motor 71 is transmitted to those elements 25, 60 62, 51 via respective well-known transmission devices each including gears and a drive shaft.

The ASIC 70 additionally produces, according to a command supplied from the CPU 65, a phase drive signal to drive the CR motor 73, and supplies the signal to a driver circuit 74 to drive the CR motor 73 and thereby control the rotation thereof.

The driver circuit 74 drives the CR motor 71. Based on the output signal supplied from the ASIC 70, the driver circuit 74 produces an electric signal to drive the CR motor 73. In response to the electric signal, the CR motor 73 is rotated and the rotation force of the motor 73 is transmitted to the carriage 38 via the carriage driving device 46, so that the carriage 38 is reciprocated in the main scanning direction. Thus, the control portion 64 controls the reciprocation of the carriage 38.

A driver circuit 75 is for driving the ink-jet recording head 39 at appropriate timings to eject, from appropriate nozzles 53 thereof, droplets of the inks toward the recording sheet. Based on a driving control procedure indicated by the CPU 65, the ASIC 70 produces an output signal to drive and control the recording head 39. The driver circuit 75 is provided in the head control substrate, and the flat cable 85 transmits signals from the main substrate constituting the control portion 64, to the head control substrate.

The ASIC 70 is coupled with the rotary encoder 76 that detects the amount of rotation of the feed roller 60, and also with the linear encoder 77 that detects the position of the carriage 38. When the MFD 1 is powered on, the carriage 38 is moved to an initial position provided at one of the lengthwise opposite ends of the pair of guide rails 43, 44, so that the position detected by the linear encoder 77 is initialized. When the carriage 38 is moved from the initial position on the guide rails 43, 44, the optical sensor 35 mounted on the carriage 38 detects the optical pattern of the encoder strip 50 and produces a pulse signal, so that based on a total number of the pulses of the pulse signal, the control portion 64 can recognize an amount of movement of the carriage 38. The control portion 64 controls, based on the thus obtained movement amount of the carriage 38, the rotation of the CR motor 73 and thereby controls the reciprocating movement of the carriage 38.

The ASIC 70 is additionally coupled with the scanner portion 3; the operation panel 18 that is manually operable for inputting user's commands to the MFD1; the slot portion 19 in which various small-size memory cards can each be inserted; and a parallel interface 78 and a USB interface 79 for communicating data with an external information device such as a personal computer via a parallel cable and a USB cable, respectively. Moreover, the ASIC 70 is coupled with an NCU (network control unit) 80 and a modem 81 that cooperate with each other to enable the MFD 1 to function as a facsimile machine.

Figure 8:
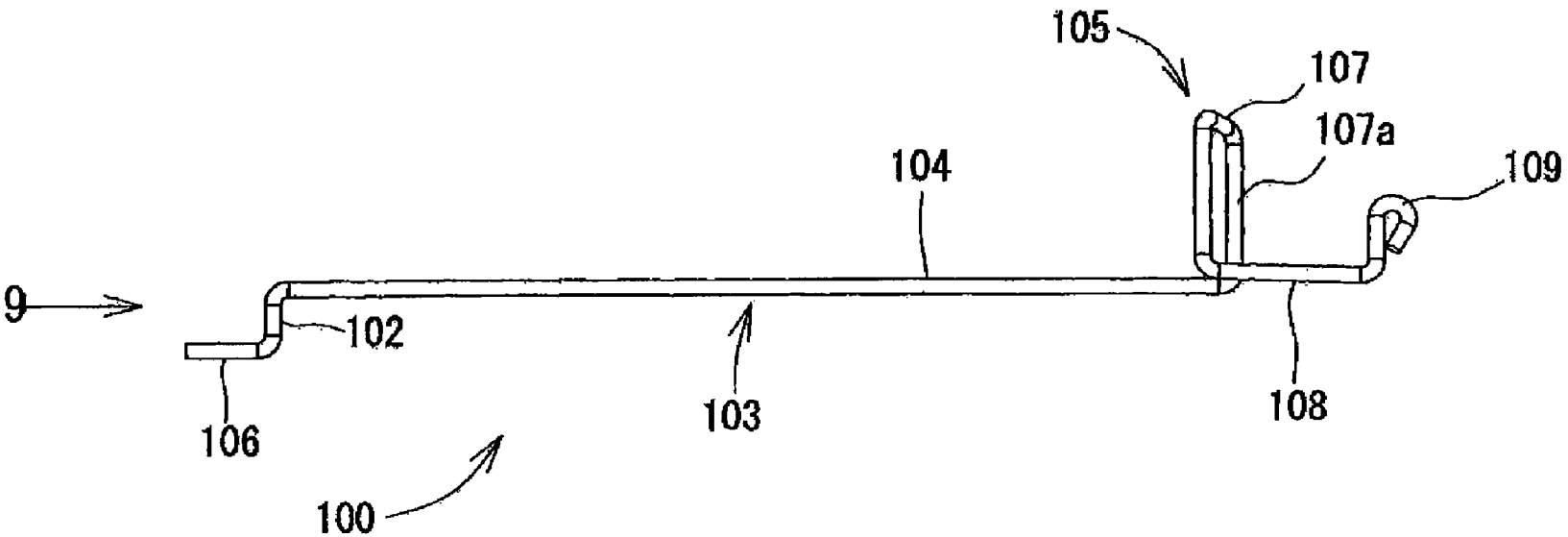
FIG. 8 is a front elevation view of a pivotable support member 100.
Figure 9:
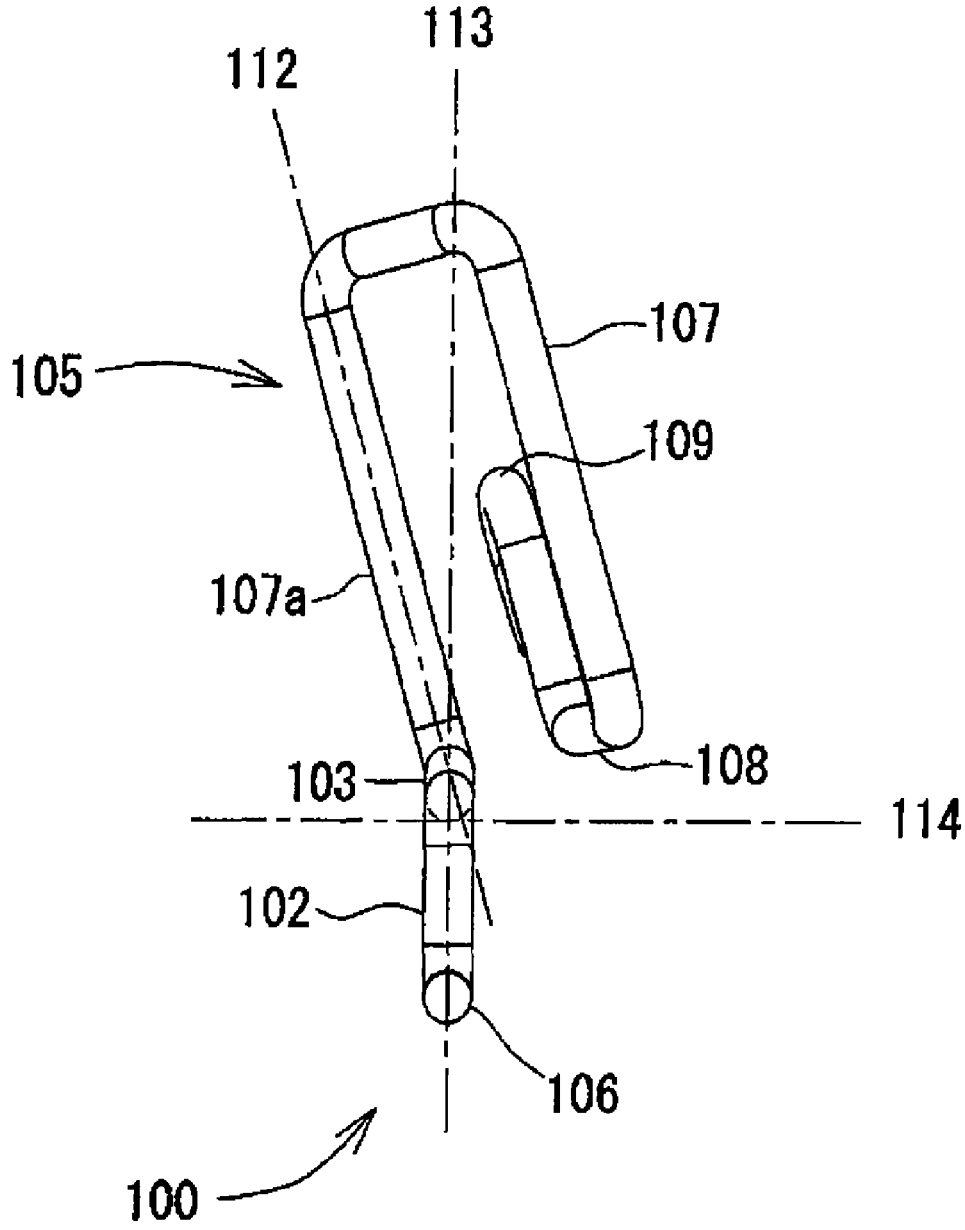
FIG. 9 is a side elevation view of the pivotable support member 100 as seen in a direction indicated by Arrow 9 in FIG. 8.
Figure 10:
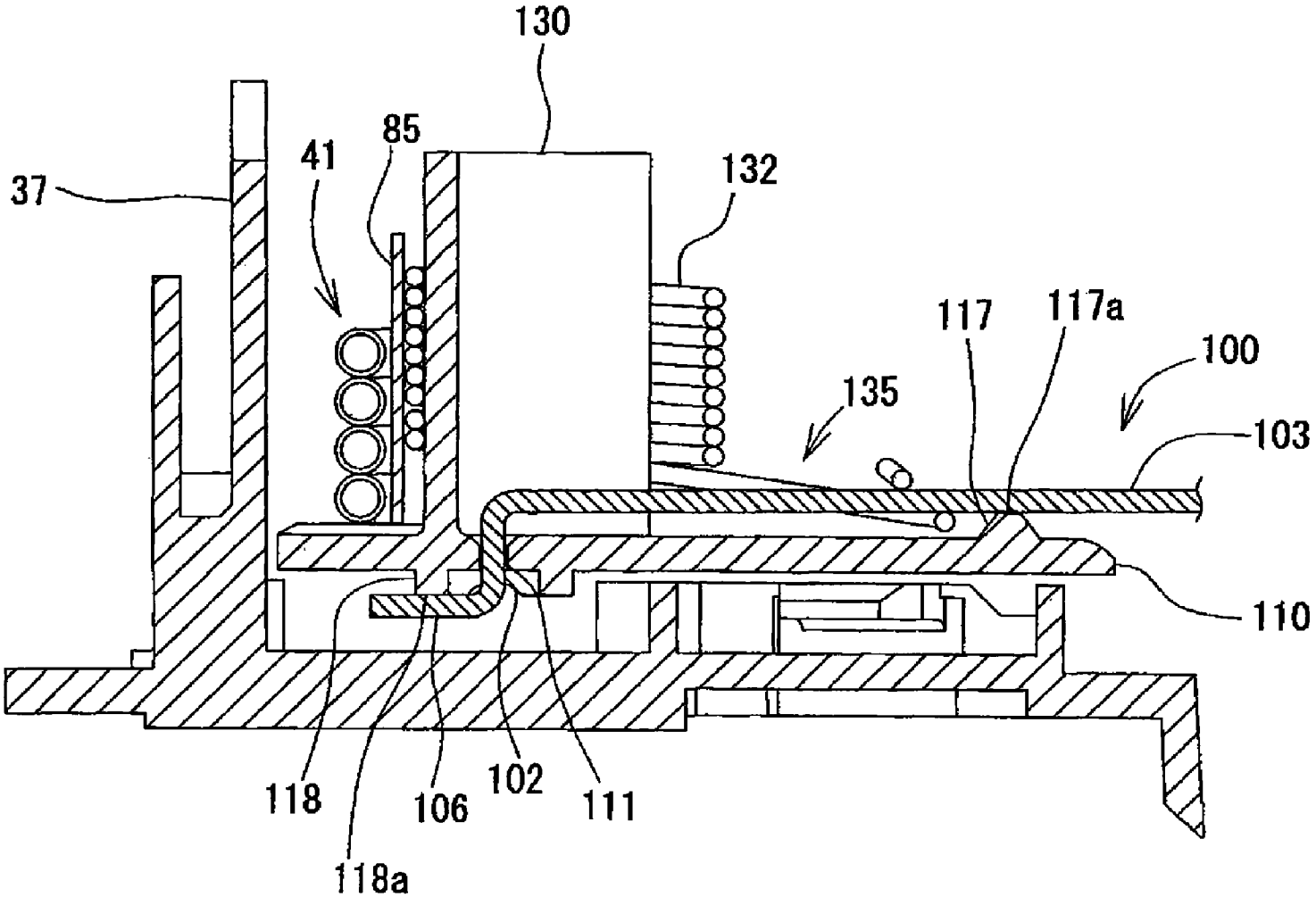
FIG. 10 is a cross-section view taken along 10-10 in FIG. 15.

Hereinafter, there will be described in detail the pivotable support member 100 that supports the four ink tubes 41 and the flat cable 85. FIG. 8 is a front elevation view of the pivotable support member 100; FIG. 9 is a side elevation view of the same 100; and FIG. 10 is a cross-section view taken along 10-10 in FIG. 15. In FIG. 10, a holding portion 105 as a first support portion of the pivotable support member 100 is not shown.

As shown in FIG. 8, the pivotable support member 100 includes a shaft portion 102 as a supporting point for pivotal motion of the support member 100; a main arm portion 103 that horizontally extends from the shaft portion 102; a support portion 104 as a second support portion of the support member 100 that is integrally formed with an upper end portion of the main arm portion 103; the holding portion 105 provided by a free end portion of the main arm portion 103; and an auxiliary arm portion 106 that horizontally extends from the shaft portion 102 in a direction opposite to the direction of extension of the main arm portion 103 and cooperates with the shaft portion 102 and the main arm portion 103 to constitute a crank-like portion. The pivotable support member 100 is formed by bending a single steel wire rod. Thus, all portions 102, 103, 104, 105, 106 of the pivotable support member 100 are integral with each other.

The main arm portion 103 and the auxiliary arm portion 106 are bent substantially perpendicularly to the shaft portion 102, such that the main arm portion 103 and the auxiliary arm portion 106 are substantially parallel to each other. The supporting device that pivotally supports the pivotable support member 100 will be described in detail, later. In short, as shown in FIG. 10, the supporting device includes a base plate 110 that has a holding hole 111 and is fixed to the housing 2*b* of the printer portion 2, and the auxiliary arm portion 106 of the support member 100 is passed through the holding hole 111 and is located on an underside of the base plate 110, so that the shaft portion 102 is pivotally held by the holding hole 111, that is, the support member 100 is pivotally supported by the base plate 110. As shown in FIGS. 4 and 10, the shaft portion 102 is supported such that the shaft portion 102 is pivotable about a substantially vertical axis line 113 (FIG. 9) and the main shaft portion 103 extends substantially horizontally therefrom. The shaft portion 102 is held by the holding hole 111, such that the shaft portion 102 is slideable in a circumferential direction thereof relative to an inner surface of the holding hole 111. Therefore, when a load is applied to the main arm portion 103, the main arm portion 103 is pivoted about the vertical axis line 113 defined by the shaft portion 102, along a substantially horizontal plane.

The upper end portion of the main arm portion 103 that extends horizontally provides the support portion 104 that supports a lower end of the flat cable 85 taking the posture that the opposite major surfaces of the cable 85 extend vertically. When the flat cable 85 follows the reciprocation of the carriage 38 while changing its shape, the cable 85 is slideable on the support portion 104. That is, a length of the main arm portion 103 the upper end of which provides the support portion 104 is so selected as to assure that when the carriage 38 is reciprocated within the prescribed range, the support portion 104 can support the flat cable 85 such that the cable 85 is slideable on the support portion 104.

The holding portion 105 as the free end portion of the main arm portion 103 is for holding the four ink tubes 41 (41*a*, 41*b*, 41*c*, 41*d*). The holding portion 105 includes a loop 107 having a generally rectangular shape that is elongate in a vertical direction; a base portion 108 projecting outward from the loop 107; and a rounded portion 109 as a free end portion of the base portion 108. The four ink tubes 41 are passed through the loop 107 of the holding portion 105. Inner length (height) and width of the loop 107 have such a dimensional relationship with respective outer diameters of the four ink tubes 41 that the order of arrangement of the four tubes 41 does not change in the loop 107 and the four tubes 41 are slideable relative to the loop 107 in a direction of extension of the tubes 41. For example, in the case where each of the respective outer diameters of the four ink tubes 41 is expressed as A and the inner height and width of the loop 107 are expressed as H and L, respectively, the above-indicated dimensional relationship is expressed as follows: $A \leqq L < 2A$, and $4A \leqq H$. The loop 107 is formed by first bending an end portion of a steel wire rod such that the end portion extends upward from the main arm portion 103, and additionally bending the end portion to have an elongate rectangular shape. The base portion 108 of the holding portion 105 extends in substantially the same direction as the direction of extension of the main arm portion 103. A free end portion of the base portion 108 is first bent upward and then is rounded downward like an arc to form the rounded portion 109.

As shown in FIG. 9, an axis line 112 (i.e., a centerline of the steel wire rod) of a rising portion 107*a* of the loop 107 that rises from the main arm portion 103 is inclined relative to the axis line 113 (i.e., a centerline of the steel wire rod) of the shaft portion 102. More specifically described, the axis line 113 of the shaft portion 102 is vertical, whereas the axis line 112 of the rising portion 107*a* of the loop 107 is inclined relative to a vertical direction. Thus, the inclined rising portion 107*a* is provided on an opposite side of the horizontal main arm portion 103 that is opposite to the base portion 108. Since the loop 107 has the rectangular shape elongate in a direction parallel to the inclined axis line 112, the fact that the inclined rising portion 107*a* is provided opposite to the base portion 108 with respect to the main arm portion 103 means that the base portion 108 has a position higher than the main arm portion 103. That is, the base portion 108 has a position higher than a virtual support plane on which the main arm portion 103 is supported by the base plate 110.

The four ink tubes 41 are passed through the loop 107 of the holding portion 105, and are supported by the base portion 108. Thus, the respective lengthwise intermediate portions of the four ink tubes 41 are slideably held by the holding portion 105. The loop 107 surrounds the four ink tubes 41, and holds the four tubes 41 in the same vertical arrangement as that in which the first fixing clip 36 fixes the four tubes 41. Therefore, when the four ink tubes 41 follow the carriage 38 while changing their shapes, the four tubes 41 can be prevented from being scattered, i.e., being largely separated from each other, and the above-indicated intermediate portions of the four tubes 41 can change their shapes in an integral manner while maintaining their vertical arrangement at the first fixing clip 36. The ink tubes 41, surrounded by the loop 107, are slideable in the direction of extension of the tubes 41 and, when the tubes 41 change their shapes, the tubes 41 can actually slide by respective appropriate amounts relative to the loop 7. Thus, no excessively high load is applied to the ink tubes 41. On the other hand, when the ink tubes 41 change their shapes, friction is produced between the tubes 41 and the loop 107, so that a rotation force to rotate or pivot the pivotable support member 100 is transmitted to the same 100.

Respective portions of the ink tubes 41 that are held by the holding portion 105 are lengthwise pre-selected based on the manner in which the tubes 41 change their shapes. When the carriage 38 is moved to a position (i.e., the above-described capping position), shown in FIG. 15, where a radius of curvature of the U-shaped curved portion of each of the four ink tubes 41 takes a maximum value, and if the tubes 41 extend from the carriage 38 in a direction having a component away from the first fixing clip 36, then the holding portion 105 needs to hold respective portions of the ink tubes 41 that are located nearer to the first fixing clip 36 than respective nearest portions 121 of the ink tubes 41 that are the nearest to the rear wall of the MFD 1, i.e., located on the left-hand side of the nearest portions 121 in FIG. 15. On the other hand, if the ink tubes 41 extend from the carriage 38 in a direction having no component away from the first fixing clip 36, then the holding portion 105 needs to hold respective portions of the tubes 41 that are located nearer to the first fixing clip 36 than respective portions 123 of the ink tubes 41 where a virtual straight line 122 extending parallel to the sheet-feed direction from the first fixing clip 36 toward the rear wall of the MFD 1 intersects the tubes 41.

Figure 14:
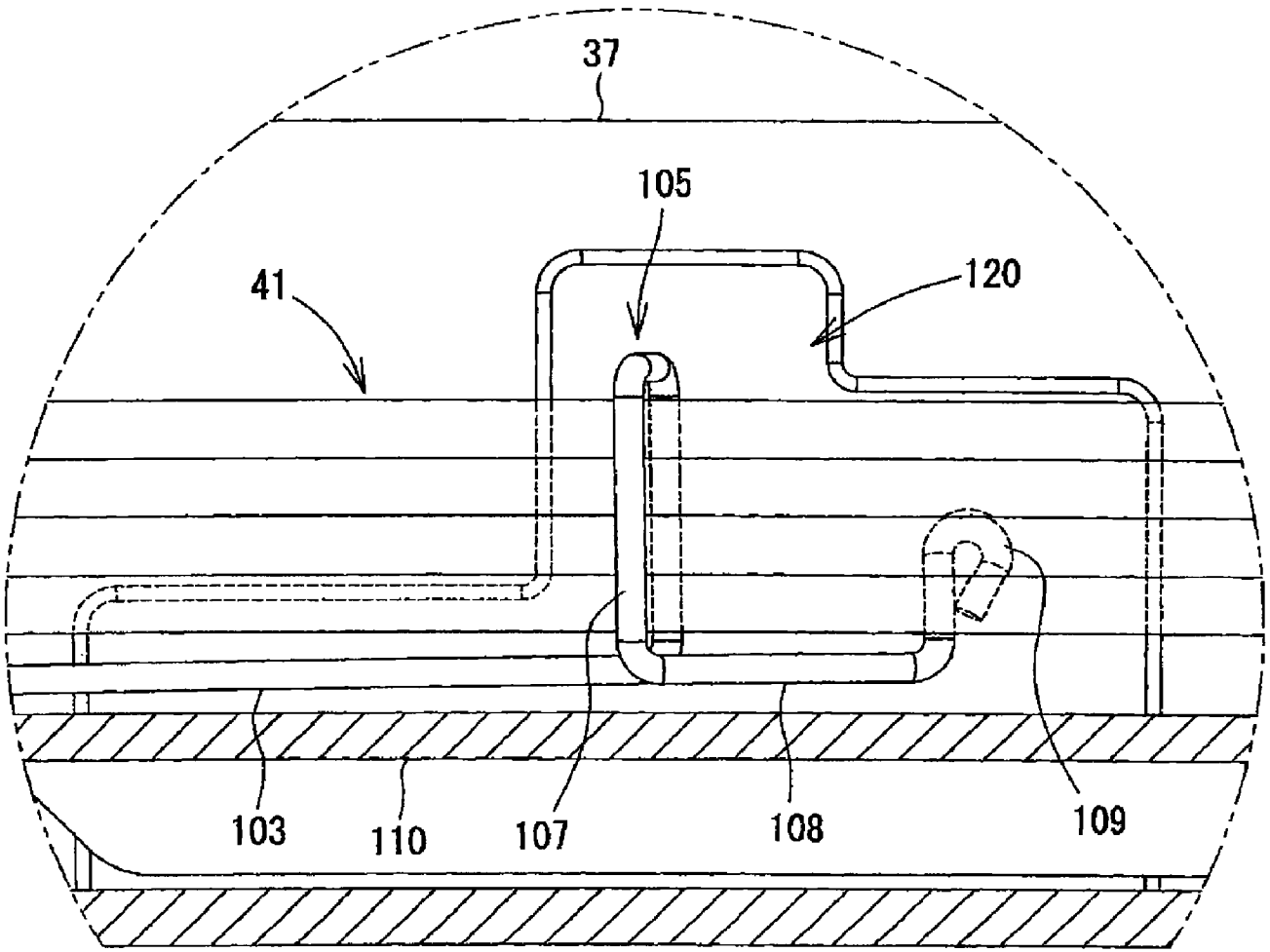
FIG. 14 is an enlarged view of a portion of a restrictor wall 37 as seen in a direction indicated by Arrow 14 in FIG. 16.

In the case where the respective lengthwise pre-selected portions of the ink tubes 41, held by the loop 107 of the holding portion 105, belong to those portions of the tubes 41 that can change their shapes along the restrictor wall 37, the pre-selected portions, surrounded by the loop 107, can be brought into contact with the restrictor wall 37 when the tubes 41 follow the carriage 38. As described previously, since the loop 107 maintains the vertical arrangement of the four ink tubes 41, the ink tubes 41 are brought into contact with the restrictor wall 37 with the vertical arrangement of the tubes 41 being unchanged. Thus, the four ink tubes 41 are uniformly contacted with the restrictor wall 37, in such an advantageous manner in which no stress is concentrated on any particular one of the four tubes 41. As shown in FIG. 14, the restrictor wall 37 has a receiving recess 120 at a position where the holding portion 105 is brought into contact with the wall 37. The receiving recess 120 will be described later.

The four ink tubes 41 that are surrounded by the loop 107 are additionally supported by the base portion 108 that is more distal than the loop 107. As described previously, the base portion 108 is provided at a position higher than the main arm portion 103. Therefore, the lowest one of the four ink tubes 41 supported by the base portion 107 is higher than the lower end of the flat cable 85 supported by the support portion 104.

When the ink tubes 41 follow the carriage 38 while changing their shapes, the tubes 41 that are supported by the base portion 108 are slideable on the base portion 108 that is more distal than the loop 107. That is, the ink tubes 41 can slide on the base portion 108 located between the loop 107 and the rounded portion 109. Since the rounded portion 109 is formed by bending the free end portion of the base portion 108 upward, the ink tubes 41 can be prevented from falling off the base portion 108. In addition, since the rounded portion 109 is rounded downward like an arc, the ink tubes 41 are prevented from being contacted with an acuminate free end of the steel wire rod constituting the pivotable support member 100.

Hereinafter, there will be described the construction of the supporting device that supports the pivotable support member 100 and includes the base plate 110, by reference to FIGS. 4, 10, 11, 12, 13 and 14.

As shown in FIG. 4, the base plate 110 is fixed to the housing 2*b* of the printer portion 2, on the rear side of the restrictor wall 37 where the carriage 38 is provided. The base plate 110 is a flat member having substantially the same length as that of the restrictor wall 37, and a width that assures that the flat member is accommodated in a space left between the restrictor wall 37 and the downstream-side guide rail 44.

Figure 11:
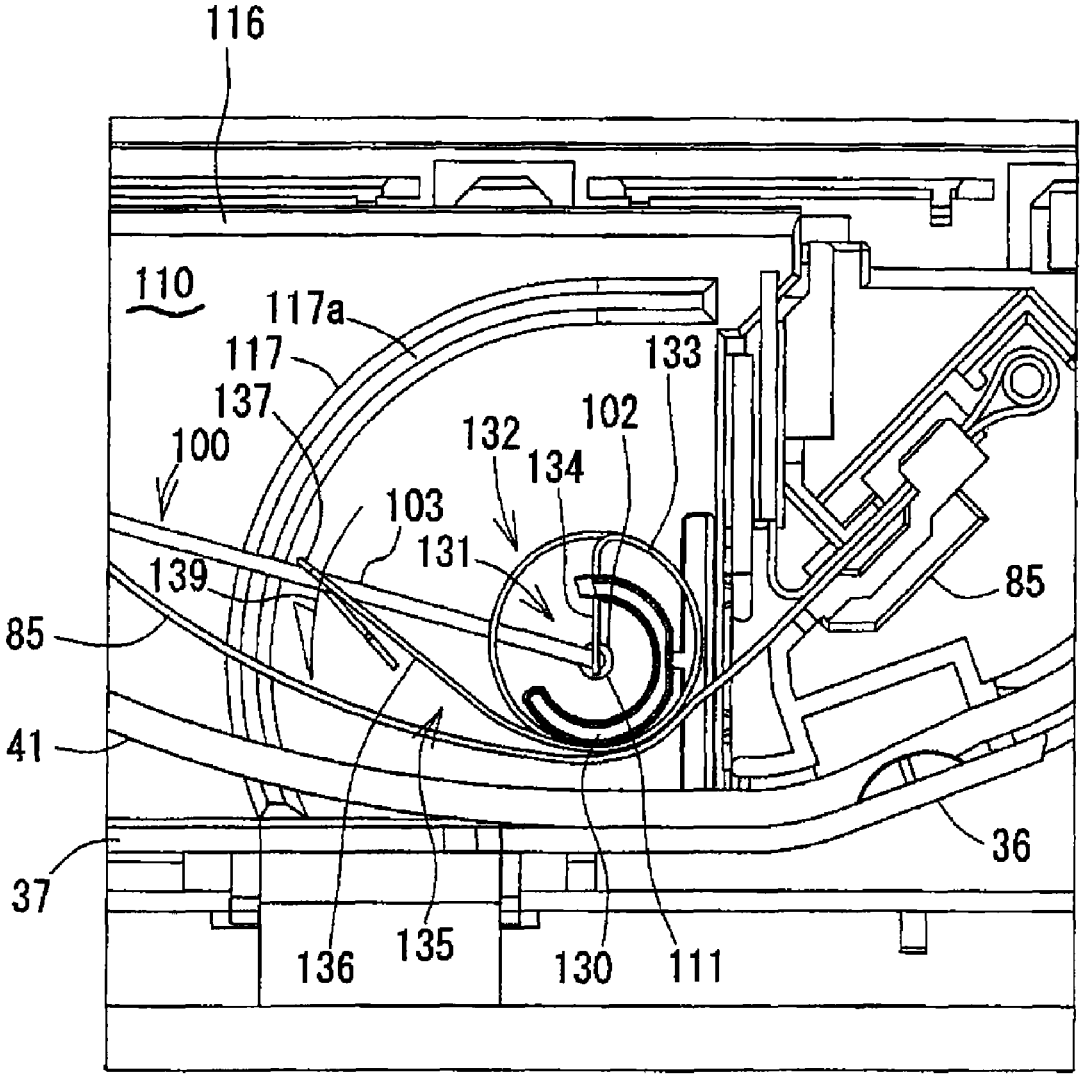
FIG. 11 is an enlarged plan view of the pivotable support member 100 and a supporting device that supports the same 100.

As shown in FIGS. 4, 10, and 11, the base plate 110 has the holding hole 111 that extends vertically and pivotally holds the shaft portion 102 of the pivotable support member 100. In the plan views shown in FIGS. 4 and 11, the holding hole 111 is provided within an area that is defined by the respective U-shaped curved portions of the ink tubes 41 and the flat cable 85 that change their shapes to follow the carriage 38. The shaft portion 102 of the pivotable support member 100 is pivotally held or supported by the holding hole 111, such that the main arm portion 103 extends substantially horizontally to support the ink tubes 41 and the flat cable 85. A distance between the holding hole 111 and a rear-side edge portion 116 of the base plate 110 is shorter than a length of the main arm portion 103 (FIG. 8) located between the shaft portion 102 and the holding portion 105. Therefore, when the main arm portion 103 is pivoted about the axis line 113 of the shaft portion 102, the pivotable support member 100 as a whole is pivoted between a first angular position, shown in FIG. 16, where the main arm portion 103 and the holding portion 105 are located above an upper surface of the base plate 110, and a second angular position, shown in FIG. 15, where the holding portion 105 is located outside the upper surface of the base plate 110.

As shown in FIGS. 4, 10, and 11, the base plate 110 has, on the upper surface thereof a first support rib 117 that surrounds the holding hole 111 and supports the main arm portion 103. The first support rib 117 has an arcuate shape whose center is located on the holding hole 111, and projects upward from the upper surface of the base plate 110 (FIG. 10). The first support rib 117 extends over an angular range within which the main arm portion 103 is pivoted. A distance between the holding hole 11 and the first support rib 117 has no limitations. However, the nearer the first support rib 117 is to the holding portion 105, the more accurately the height position of the holding portion 105 can be defined. Within the angular range in which the main arm portion 103 is pivoted, an upper end surface 107*a* of the first support rib 117 contacts and supports the main arm portion 103. The first support rib 117 has a constant height over an entire length thereof along the upper surface of the base plate 110, so as not to change the height position of the upper end surface 107*a* of the first support rib 117 within the range of pivotal motion of the arm portion 103. The constant height of the first support rib 117 is pre-selected at a value assuring that the holding portion 105, in particular, the base portion 108 (FIG. 8) is spaced from the upper surface of the base plate 110.

As shown in FIG. 10, the base plate 110 has, on a lower surface thereof, a second support rib 118 that surrounds the holding hole 111 and supports the auxiliary arm portion 106. Although not shown in the figure, the second support rib 118 has, like the first support rib 117, an arcuate shape whose center is located on the holding hole 111, and projects downward from the lower surface of the base plate 110. The second support rib 118 extends over an angular range within which the auxiliary arm portion 106 is pivoted as the main arm portion 103 is pivoted. A distance between the holding hole 11 and the second support rib 118 has no limitations. However, the remoter the second support rib 118 is from the holding hole 111, the greater the supporting force of the second support rib 118 applied to the auxiliary arm portion 106 is. Within the angular range in which the auxiliary arm portion 106 is pivoted as the main arm portion 103 is pivoted, a lower end surface 108*a* of the second support rib 118 contacts and supports the auxiliary arm portion 106. The second support rib 118 has a constant height over an entire length thereof along the lower surface of the base plate 110, so as not to change the height position of the lower end surface 108*a* of the second support rib 118 within the range of pivotal motion of the auxiliary arm portion 106. The constant height of the second support rib 118 is pre-selected at a value assuring that the holding portion 105, in particular, the base portion 108 thereof is spaced from the upper surface of the base plate 110.

Owing to the first support rib 117 formed on the base plate 110, the main arm portion 103 is supported at an appropriate height, such that the holding portion 105 is spaced from the upper surface of the base plate 110. Thus, the base portion 108 of the holding portion 105 is prevented from being interfered with by the upper surface of the base plate 110. In addition, since the second support rib 118 also contributes to supporting the main arm portion 103 at the appropriate height, the holding portion 105 can be maintained spaced from the upper surface of the base plate 110. Thus, the first and second support ribs 117, 118 cooperate with each other to maintain reliably the holding portion 105 spaced from the upper surface of the base plate 110 within the range of pivotal motion of the main arm portion 103.

As shown in FIGS. 10 through 13, a generally part-cylindrical guide member 130 as a stationary member or a tubular member projects from the upper surface of the base plate 110 at a position spaced from the restrictor wall 37 in a direction toward the carriage 38, such that the guide member 130 partly surrounds the holding hole 111 and a centerline of the guide member 130 coincides with a centerline of the holding hole 111. The guide member 130 has an upward opening recess 131 as an opening thereof that opens in an upper end surface thereof and horizontally extends over an angular range corresponding to the range of pivotal motion of the pivotable support member 100. The main arm portion 103 horizontally extending from the shaft portion 102 pivotally held by the holding hole 111, passes through the upward opening recess 131. In other words, the recess 131 defines or restricts the range of pivotal motion of the pivotable support member 100.

The guide member 130 supports a torsion coil spring 132 as a sort of spring member as a sort of biasing member or device. The torsion coil spring 132 is formed by winding a metal wire such as a steel wire, and includes a cylindrical coil portion 133, a first arm portion 134 as a fixed end portion that extends radially inward from the coil portion 133 and is fixed to the guide member 130, and a second arm portion 135 as an engaged end portion that extends radially outward from the coil portion 133 and is engaged with an intermediate portion of the main arm portion 103. The torsion coil spring 132 can receive a torsion moment with respect to an axis line (i.e., a centerline) of the cylindrical coil portion 133. When the first and second arm portions 134, 135 receive respective loads, a torque is produced in a circumferential direction of the cylindrical coil portion 133. In the present embodiment, the torsion coil spring 132 is employed as a sort of biasing member. However, any sort of spring or any sort of biasing member that can produce a torque may be employed. For example, the torsion coil spring 132 may be replaced with a different sort of torsion spring, a different sort of coil spring, a spiral spring (i.e., a power spring), or a volute spring.

Figure 12:
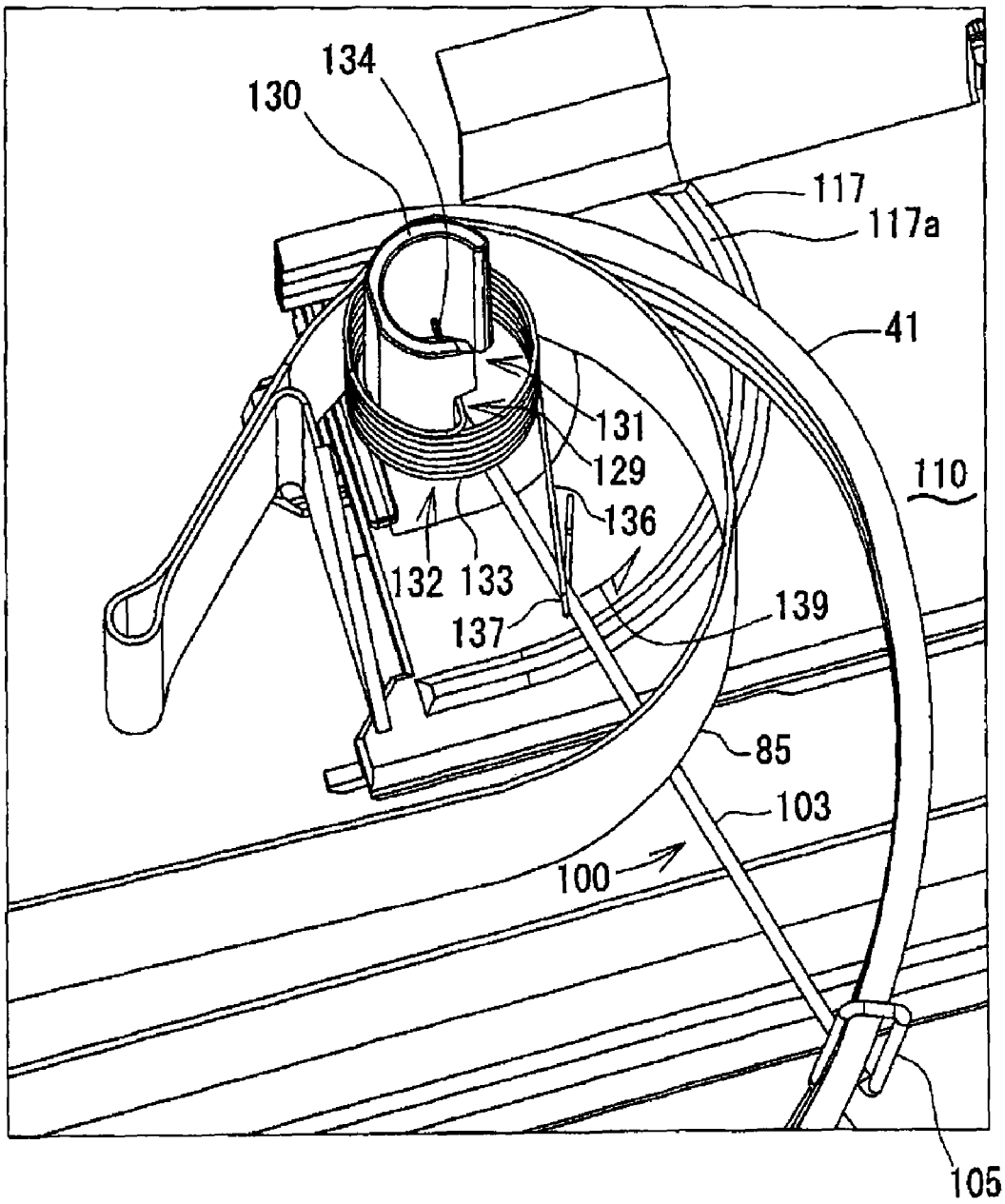
FIG. 12 is an enlarged perspective view of the pivotable support member 100 and the supporting device.
Figure 13:
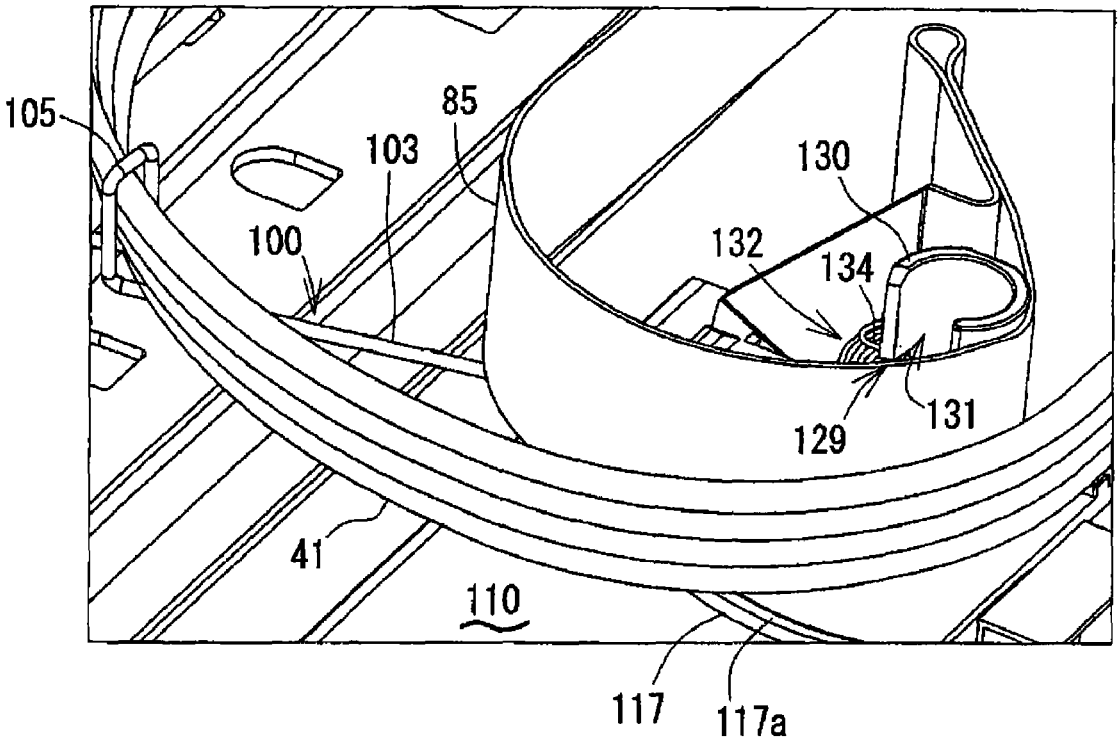
FIG. 13 is another enlarged perspective view of the pivotable support member 100 and the supporting device.

As shown in FIGS. 12 and 13, the guide member 130 has a supporting or engaging recess 129 that opens in the upward open recess 131, and the torsion coil spring 132 is fixed to the guide member 130 such that the first arm portion 134 of the coil spring 132 is engaged with the engaging recess 129 of the guide member 130.

As shown in FIGS. 11 and 12, the second arm portion 135 includes a straight portion 136 extending radially outward from the coil portion 133, and a curved portion 137 that is formed by bending a free end portion of the straight portion 136 and is engaged with the intermediate portion of the main arm portion 103 of the pivotable support member 100. An inner diameter of the curved portion 137 is designed to be somewhat greater than an outer diameter of the main arm portion 103 so as to introduce easily the arm portion 103 thereinto and hold the same 103. The curved portion 137 may be formed by bending back the free end portion of the straight portion 136 by an appropriate angle. This angle may be arbitrarily selected so long as it assures that the main arm portion 103 does not come off the curved portion 137. In the present embodiment, the angle is about 180 degrees. In the case where the angle is greater than 180 degrees and accordingly a distance between a free end of the curved portion 137 and the straight portion 136 is smaller than the outer diameter of the arm portion 103, the main arm portion 103 can be more effectively prevented from coming off the curved portion 137.

As shown in FIGS. 11 and 12, the torsion coil spring 132 is attached to the guide member 130 such that the coil spring 132 biases the pivotable support member 100 in a direction indicated by an arrow 139. More specifically described, the coil spring 132 is attached to the guide member 130, in such manner that first the coil spring 132 is moved toward the guide member 130, so as to cause an upper end of the guide member 130 to enter a lower end of the coil portion 133 from which the second arm portion 135 extends outward, and second the curved portion 137 of the second arm portion 135 is engaged with the main arm portion 103 of the support member 100. Then, with the second arm portion 135 being kept still, the coil portion 133 is twisted by an appropriate angle in a direction to produce a load or a biasing force in the direction indicated by the arrow 139. In this state, i.e., with this biasing force being maintained, the first arm portion 134 is engaged with the engaging recess 129 of the guide member 130. The torsion coil spring 132, thus attached to the guide member 130, exhibits its special effect, mainly when the carriage 38 is moved to the capping position, shown in FIG. 15, where the radius of curvature of the U-shaped curved portion of the flat cable 85 increases. The operation and advantages of the torsion coil spring 132 will be described later.

In the present embodiment, the guide member 130 not only supports the torsion coil spring 132 but also guides the ink tubes 41 and the flat cable 85 in the direction along the restrictor wall 37. As described previously, the guide member 130 is spaced from the restrictor wall 37 in the direction toward the carriage 38, and the ink tubes 41 and the flat cable 85 are passed through the space present between the restrictor wall 37 and the guide member 130. Since the ink tubes 41 and the flat cable 85 can abut on an outer circumferential surface of the guide member 130 that has a cylindrical shape, those elements 41, 85 can be prevented from being excessively largely bent at the first fixing clip 36 or the second fixing clip 86 in the direction toward the carriage 38. That is, the ink tubes 41 and the flat cable 85 can be led in the direction along the restrictor wall 37, without being locally buckled at the first or second fixing clip 36, 38. In addition, respective centers of the respective U-shaped curved portions of the ink tubes 41 and the flat cable 85 that are formed when those elements 41, 85 are moderately bent back toward the carriage 38 can be made nearer to the restrictor wall 37. Thus, respective inner areas defined by the respective curved portions of the ink tubes 41 and the flat cable 85 can be prevented from being increased, and respective lengths of the respective intermediate portions of those elements 41, 85 located between the first or second fixing clip 36, 38 and the carriage:38 can be minimized.

As shown in FIG. 14, the restrictor wall 37 has the receiving recess 120 that assures that the wall 37 is prevented from abutting on the holding portion 105 of the pivotable support member 100 that holds the lengthwise pre-selected portions of the ink tubes 41. In the present embodiment, the receiving recess 120 is provided in the form of a through-hole that is formed through a thickness of the restrictor wall 37. However, in the case where the restrictor wall 37 is considerably thick, the recess 120 may be provided in the form of a groove that is formed in the rear-side surface of the restrictor wall 37. Otherwise, the restrictor wall 37 may be completely divided into two parts by the receiving recess 120. The recess 120 has a shape corresponding to that of a portion of the support member 110 that is provided around the holding portion 105 including the loop 107, the base portion 108, and the rounded portion 109. However, the receiving recess 120 may have any shape so long as the recess 120 can prevent the restrictor wall 37 from abutting on the holding portion 105 of the support member 100. Thus, in the state in which the ink tubes 41 are in abutment on the rear-side surface of the restrictor wall 37, the holding portion 105 of the support member 100 is accommodated by the receiving recess 120 without engaging the restrictor wall 37 per se.

Figure 17:
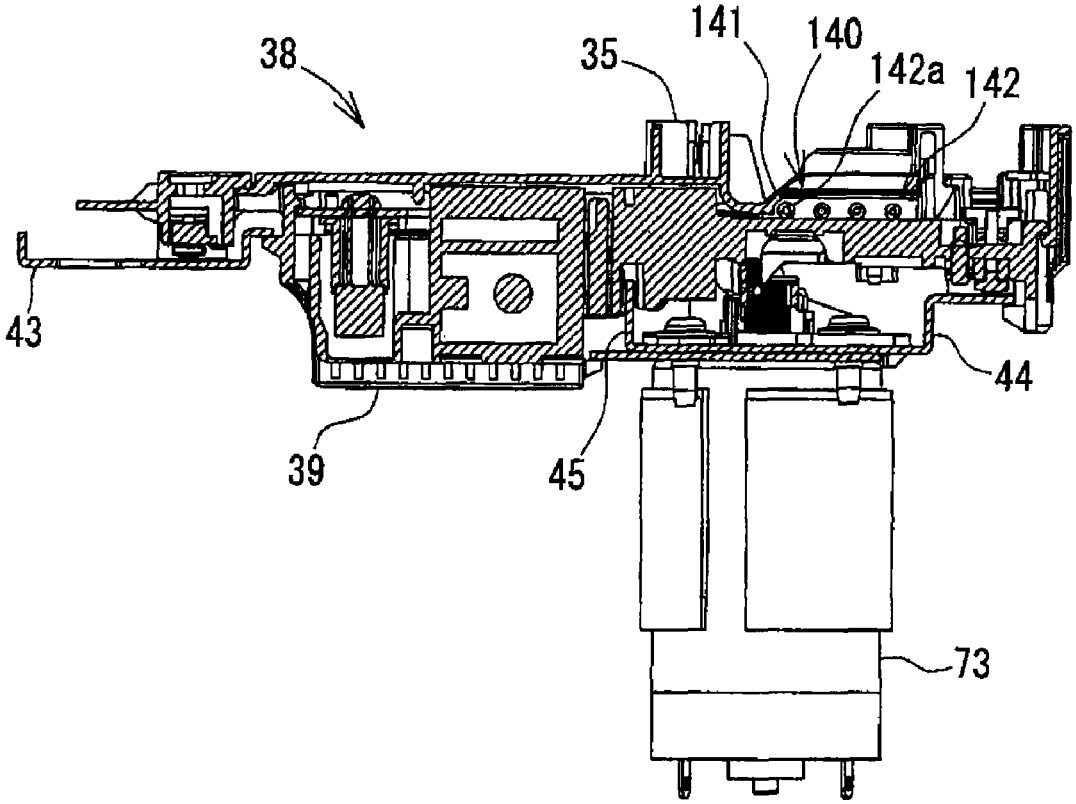
FIG. 17 is a cross-section view taken along 17-17 in FIG. 15.
Figure 18:
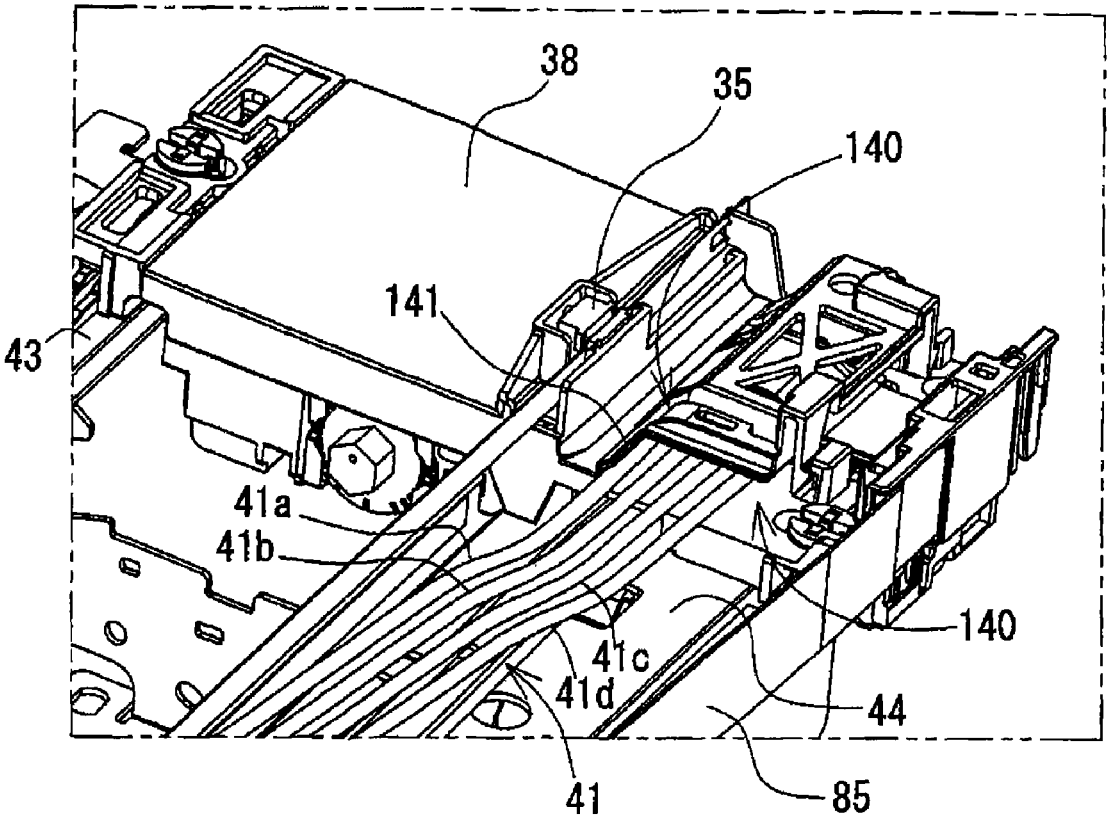
FIG. 18 is an enlarged perspective view of a carriage 38 that is stopped at a capping position.

Next, there will be described the tube connection portion 140 of the carriage 38, by reference to FIGS. 17 and 18. In FIG. 17, the ink tubes 41 are not shown.

As described heretofore, the four ink tubes 41 are first lead from the cartridge accommodating portion along the rear-side surface of the restrictor wall 37, second are moderately bent back toward the carriage 38 while forming the respective curved portions, and finally are connected to the tube connection portion 140 of the carriage 38. As shown in FIGS. 17 and 18, the tube connection portion 140 includes four tube joints 142 corresponding to the four sorts of inks, respectively, and a tube guide 141 as a restrictor member that guides or restricts a most upstream one 41*a* of the four ink tubes 41*a*, 41*b*, 41*c*,

41*d*, i.e., deflects a direction of extension of the ink tube 41*a* to an appropriate direction having a component toward the restrictor wall 37.

The four tube joints 142 are horizontally arranged in a predetermined order in the sheet-feed direction such that the four joints 142 are spaced from each other at regular intervals. The tube joints 142 are formed of a synthetic resin, and project from the carriage 38 in a, direction parallel to the direction of reciprocation thereof. The four ink tubes 41 are connected to the carriage 38 such that the ink tubes 41 fit on the tube joints 142, respectively.

The most upstream one 41*a* of the four ink tubes 41 is connected to the most upstream one 142*a* of the four tube joints 142 as seen in the sheet-feed direction. The tube guide 141 is provided on an upstream side of the most upstream tube joint 142*a* in the sheet-feed direction. The tube guide 141 is integrally formed with a box-like frame of the carriage 38. The tube guide 141 is for restricting or deflecting a direction in which the ink tube 41*a*, connected to the tube joint 142*a*, extends from the carriage 38, such that the ink tube 41*a* is directed downstream in the sheet-feed direction. To this end, the tube guide 141 extends in the substantially same direction as that in which the tube joint 142*a* projects from the carriage 38. However, the tube guide 141 may be somewhat inclined, relative to the direction of projection of the tube joint 142*a*, such that a distal end of the tube guide 141 from the tube joint 142*a* is directed downstream in the sheet-feed direction.

As the carriage 38 approaches the capping position, the ink tubes 41 gradually swell, due to their elasticity, over the downstream-side guide rail 44 into the space in which the carriage 38 reciprocates, i.e., the respective curved portions of the tubes 41 increase. As the curved portions of the ink tubes 41 increase, the ink tube 41*a* connected to the tube joint 142*a* may be drawn upstream as seen in the sheet-feed direction, i.e., drawn in a direction opposite to the sheet-feed direction. However, the tube guide 141 pushes back the ink tube 41*a* downstream in the sheet-feed direction, i.e., in a direction to decrease the curved portion of the ink tube 41*a*. Thus, the increasing of the curved portion of the ink tube 41*a* can be prevented. In addition, since the most upstream ink tube 41*a* contributes to preventing the respective increasing of the respective curved portions of the other ink tubes 41*b*, 41*c*, 41*d* adjacent to the ink tube 41*a*, the respective increasing of the curved portions of all the four ink tubes 41 can be prevented.

Hereinafter, there will be described an image recording operation of the printer portion 2, in particular, respective behaviors of the ink tubes 41, the flat cable 85, and the pivotable support member 100. When the driving force of the CR motor 73 is transmitted via the carriage driving device 46 to the carriage 38 carrying the ink-jet recording head 39, the carriage 38 is reciprocated in the opposite directions perpendicular to the sheet-feed direction while being guided by the two guide rails 43, 44. Based on the recording commanding signals supplied from the control portion 64 via the flat cable 85, the recording head 39 ejects, at appropriate timings, droplets of the inks supplied via the four ink tubes 41, onto the recording sheet being temporarily stopped on the platen 42. The intermittent feeding of the recording sheet by the feed roller 60 and the discharge roller 63 and the reciprocation of the carriage 38 are alternately repeated to record a desired image or images on the recording sheet.

Figure 15:
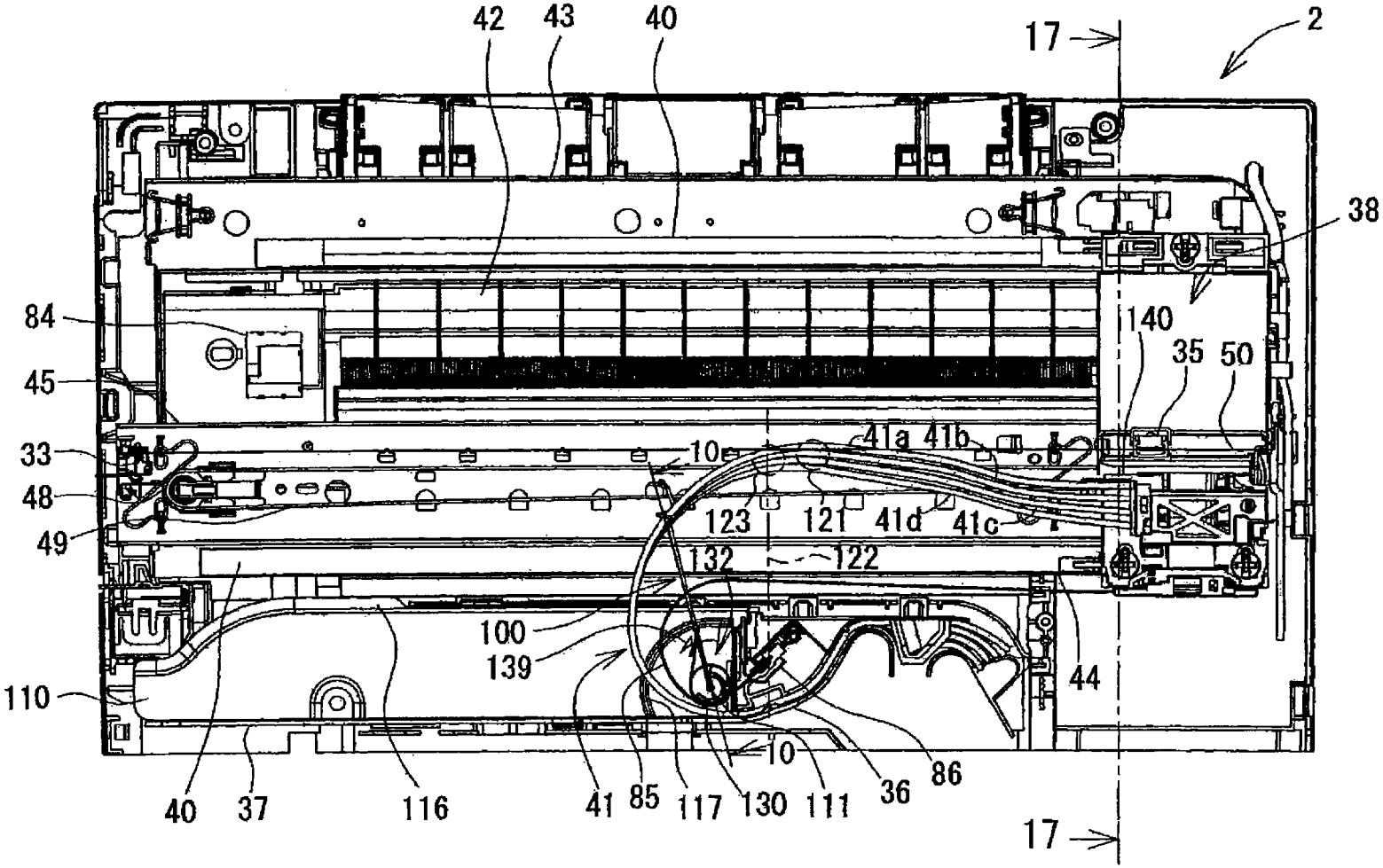
FIG. 15 is another plan view of the printer portion 2.

Since the ink tubes 41 and the flat cable 85 are connected, at respective one ends thereof, to the carriage 38, those elements 41, 85 follow the reciprocation of the carriage 38 while changing their shapes, i.e., the respective radii of curvature of the respective U-shaped curved portions thereof. FIG. 15 shows the state in which the carriage 38 is stopped at the capping position right above the cap member 52 provided in the right-hand end portion of the printer portion 2; and FIG. 16 shows the state in which the carriage 38 is stopped at the flushing position right above the waste-ink tray 84 provided in the left-hand end portion of the printer portion 2. In the present embodiment, the capping position is the initial position of the carriage 38.

As shown in FIG. 15, when the carriage 38 is positioned at the capping position, each of the ink tubes 41 and the flat cable 85 has the generally U-shaped curved configuration in which the each element 41, 85 is first led from a corresponding one of the first and second fixing clips 36, 86 toward the flushing position along the restrictor wall 37 and then is curved toward the capping position. Each of the ink tubes 41 and the flat cable 85 has a certain flexibility but also has a certain flexural rigidity. That is, each of the ink tubes 41 and the flat cable 85 has an elasticity assuring that when the each element 41, 85 is curved, the each element 41, 85 can be restored to its initial shape. Owing to the elasticity of each of the ink tubes 41, the U-shaped curved portion thereof can considerably largely swell above the downstream-side guide rail 44, such that the curved portion would otherwise go over the edge portion 116 of the base plate 110 into the range of reciprocation of the carriage 38. In fact, however, as shown in FIG. 15, the torsion coil spring 132 biases the pivotable support member 100 in the direction indicated by the arrow 139, so that the ink tubes 41 are biased toward the restrictor wall 37. Thus, the swelling of the curved portions of the ink tubes 41 can be effectively restrained. Since the flat cable 85 is supported, inside the curved portions of the ink tubes 41, by the support portion 104 of the support member 100, the flat cable 85 can be prevented from going over the ink tubes 41. That is, the swelling of the curved portions of the ink tubes 41 and the flat cable 85 can be prevented. Therefore, the printer portion 2 or the MFD 1 needs only a small space to accommodate the ink tubes 41 and the flat cable 85, and accordingly can be constructed in a reduced size. In addition, the respective lengths of the respective intermediate portions of the ink tubes 41 and the flat cable 85 that are located between the fixing clips 36, 86 and the carriage 38 can be decreased.

The ink tubes 41 and the flat cable 85 are guided by a portion of the outer circumferential surface of the guide member 130 that is opposed to the restrictor wall 37. Therefore, the ink tubes 41 and the flat cable 85 are prevented from being bent, at the fixing clips 36, 86, at an acute angle toward the carriage 38, and the respective centers of the U-shaped curved portions of those elements 41, 85 are made nearer to the restrictor wall 37. These features also contribute to preventing the swelling of the curved portions of the ink tubes 41 and the flat cable 85, decreasing the space to accommodate those elements 41, 85, and reducing the overall size of the printer portion 2 or the MFD 1. In addition, the respective lengths of intermediate portions of the ink tubes 41 and the flat cable 85 that are located between the fixing clips 36, 86 and the carriage 38 can be decreased.

As shown in FIG. 4, when the carriage 38 is moved or slid from the capping position shown in FIG. 15 toward the flushing position shown in FIG. 16, the ink tubes 41 led from the carriage 38 are directed toward the flushing position. Therefore, the ink tubes 41 and the flat cable 85 can follow the carriage 38 while changing their shapes such that the respective U-shaped curved portions thereof are decreased. Since the holding portion 105 of the pivotable support member 100 holds the ink tubes 41 such that the tubes 41 are slideable relative to the holding portion 105, the tubes 41 can slide relative to the holding portion 105 when the tubes 41 change their shapes to follow the carriage 38. If the speed of movement of the carriage38 is too fast relative to the speed of sliding of the ink tubes 41 on the holding portion 105, then respective portions of the ink tubes 41, located between the carriage 38 and the respective portions of the tubes 41 slideably held by the holding portion 105, may more largely swell. However, since the pivotable support member 100 is biased by the torsion coil spring 132 in the direction indicated by the arrow 139, the ink tubes 41 and the flat cable 85 are forcedly drawn toward the rear-side surface of the restrictor wall 37. Therefore, even if the carriage 38 may be moved at high speeds, the ink tubes 41 and the flat cable 85 can be prevented from being too largely curved.

As shown in FIG. 16, when the carriage 38 is moved to the flushing position, the respective U-shaped curved portions of the ink tubes 41 and the flat cable 85 are minimized. The fixing clips 36, 86 fix those elements 41, 85 to the rear-side surface of the restrictor wall 37, such that the curved portions thereof are elastically pressed against the restrictor wall 37, and additionally the torsion coil spring 132 elastically presses those elements 41, 85 against the restrictor wall 37. Therefore, within the range of reciprocation of the carriage 38, the changing of the respective shapes of the ink tubes 41 and the flat cable 85 are restricted by the restrictor wall 37, and the respective portions of those elements 41, 85 that are led along the restrictor wall 37 are prevented from being moved away from the wall 37. Thus, the swelling of the ink tubes 41 and the flat cable 85 in the direction toward the carriage 38 can be reduced. In addition, the swelling of the same 41, 85 in the direction away from the carriage 38 can be reduced by the restrictor wall 37. Therefore, the space needed to accommodate the changing of respective shapes of the ink tubes 41 and the flat cable 85 can be reduced.

As shown in FIG. 16, when the flat cable 85, located inside the curved portions of the ink tubes 41, follows the reciprocation of the carriage 36, the flat cable 85 may be brought into contact with the ink tubes 41. More specifically described, the curved portion of the flat cable 85 may contact the curved portion of the uppermost one 41*a* of the four ink tubes 41. As described previously, the respective intermediate portions of the four ink tubes 41, located between the first fixing clip 36 and the carriage 38, have substantially the same length, and the uppermost ink tube 41*a* at the first fixing clip 36 is led to the most upstream ink tube 41*a* (in the sheet-feed direction) at the carriage 38. That is, the vertical arrangement of the four ink tubes 41 at the first fixing clip 36 is changed into the horizontal arrangement of the same 41 at the carriage 38, such that the ink tube 41*b* adjacent to the uppermost ink tube 41*a* at the first clip 36 is led to the ink tube 41*b* adjacent to the most upstream ink tube 41*a* at the carriage 38 and this manner is repeated three times.

Figure 19:
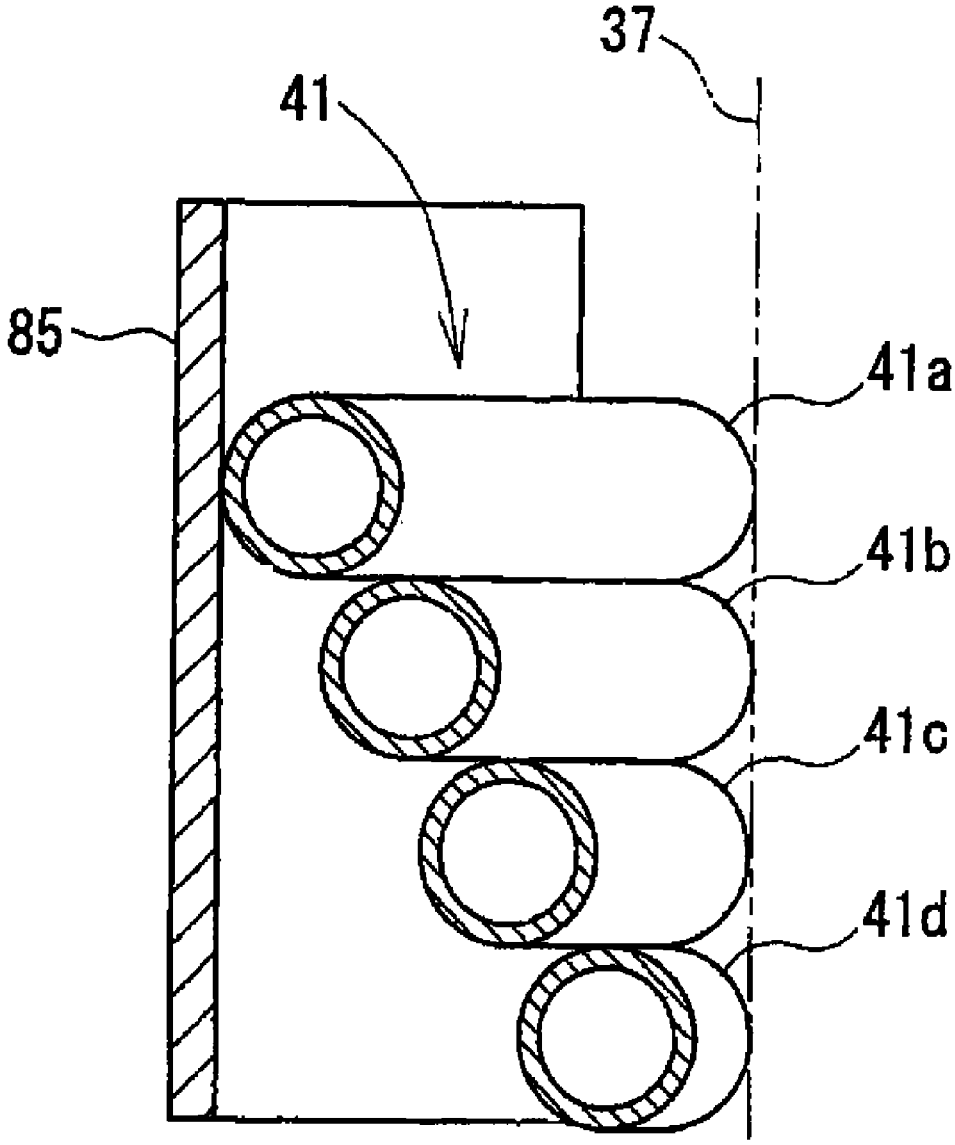
FIG. 19 is a cross-section view taken along 19-19 in FIG. 16.

FIG. 19 is a cross-section view taken along 19-19 in FIG. 16. As shown in FIG. 19, the respective curved portions of the four ink tubes 41*a*, 41*b*, 41*c*, 41*d* are arranged in an oblique direction inclined relative to a vertical direction. Therefore, when the ink tubes 41 change their shapes to follow the carriage 38, the interference of the tubes 41 with each other is reduced. In addition, the pivotable support member 100 supports the flat cable 85 such that a lower end of the cable 85 is substantially level with the ink tube 41*d* that takes the lowest position at the first fixing clip 36 and such that one of the opposite major surfaces of the cable 85 contacts the ink tube 41*a* that takes the highest position at the first clip 36. Therefore, the flat cable 85 is prevented from moving over the ink tubes 41 or moving to below the same 41. Thus, the group of ink tubes 41, and the flat cable 85 can change their shapes and follow the carriage 38, without changing their arrangement, i.e., which one of (a) the group of ink tubes 41 and (b) the flat cable 85 is located inside the other.

The ink tubes 41 and the flat cable 85 that can change their shapes are supported at appropriate height positions by the pivotable support member 100. As described previously, the ink tubes 41 are held by the holding portion 105, and the flat cable 85 is supported by the support portion 104. When the ink tubes 41 change their shapes to follow the reciprocation of the carriage 38, the changing of the respective shapes of the tubes 41 is transmitted to the main arm portion 103 via the holding portion 105, so that the main arm portion 103 is pivoted about the shaft portion 102 as the supporting point.

As shown in FIGS. 4, 15, and 16, when the flat cable 85 changes its shape to follow the reciprocation of the carriage 38, the cable 85 may slide on the support portion 104. If a specified portion of the flat cable 85 is fixed to the support portion 104 so as to be supported at an appropriate height position, a locus of movement of that specified portion of the cable 85 is limited to a certain arcuate line and accordingly the specified portion of the cable 85 may be subjected to an excessively high load. However, in the present embodiment, the support portion 104 supports the flat cable 86 such that the cable 85 is slideable on that portion 104. Therefore, when the main arm portion 103 is pivoted, the flat cable 85 can change its shape while sliding on the support portion 104. Thus, the flat cable 85 is not subjected to an excessively high load and is prevented from being damaged or broken.

As described previously, since the main arm portion 103 is pivoted about the shaft portion 102, the main arm portion 103 as a whole including the holding portion 105 is located, as shown in FIG. 16, within the space right above the upper surface of the base plate 110, when the carriage 38 is moved to the flushing position; on the other hand, the holding portion 105 is located, as shown in FIG. 15, outside the space right above the base plate 110 when the carriage 38 is moved to the capping position. Stated differently with respect to the holding portion 105, when the main arm portion 103 is pivoted from the position shown in FIG. 4 in a direction toward the capping position, the holding portion 105 is located outside the space right above the base plate 110; and when the main arm portion 103 is pivoted in the opposite direction from the capping position toward the position shown in FIG. 4, the holding portion 105 is retracted into the space right above the base plate 110.

As described previously, the loop 107 of the holding portion 105 is constructed such that the axis line 112 (FIG. 9) of the rising portion 107*a* that rises from the main arm portion 103 is inclined relative to the axis line 113 of the shaft portion 102, so that the base portion 108 of the loop 107 is located at a height position higher than the main arm portion 103. Therefore, when the holding portion 105 is retracted into the space right above the base plate 110, the base portion 108 is prevented from being interfered with by the edge portion 116 of the base plate 110. Thus, the holding portion 105 and the base plate 110 do not interfere with each other and accordingly no noise is generated.

Since the rising portion 107*a* of the loop 107 of the holding portion 105 is inclined relative to the shaft portion 102, the base portion 108 of the loop 107 is located higher than the main arm portion 103. Therefore, it is not needed to make the entirety of the loop 107 higher than the main arm portion 103. If the entirety of the loop 107 is made higher than the main arm portion 103, then the ink tubes 41 surrounded by the loop 107 are made higher than the main arm portion 103. In the latter case, it is needed to provide one or more other members, such as a cover member disposed above the space in which the ink tubes 41 change their shapes, at higher positions so that the ink tubes 41 may not be interfered with by those members. This leads to increasing the overall size of the printer portion 2 or the MFD 1. In the present embodiment, the loop 107 of the holding portion 105 is not needed to extend so largely in an upward direction from the main arm portion 103, for the purpose of preventing the base portion 108 of the loop 107 from being interfered with by the edge portion 116 of the base plate 110. Therefore, the height position of the top end of the vertical arrangement of the four ink tubes 41 can be lowered.

As described previously, the base plate 110 that supports the pivotable support member 100 has, around the holding hole 111, the first support rib 117 that supports the main arm portion 103, and the second support rib 118 that supports the auxiliary arm portion 106. The first and second support ribs 117, 118 cooperate with each other to keep the holding portion 105 of the main arm portion 103 at a height position spaced from the upper surface of the base plate 110. Thus, the base portion 108 of the loop 107 of the holding portion 105 can be more effectively prevented from being interfered with by the edge portion 116 of the base plate 110.

As shown in FIG. 16, when the carriage 38 is positioned at the flushing position, respective large portions of the ink tubes 41 are contacted with the restrictor wall 37 and are thereby restricted by the same 37. In addition, the holding portion 105 of the pivotable support member 100 is moved toward the restrictor wall 37. As described above, the restrictor wall 37 has the receiving recess 120 to avoid the abutting of the holding portion 105 thereon. Therefore, when the ink tubes 41 are contacted with the restrictor wall 37, the holding portion 105 does not abut on the restrictor wall 37 and accordingly no impact noise is produced. That is, when the pivotable support member 100 is pivoted, the support member 100 does not abut on the base plate 110 or the restrictor wall 37 and no impact noise is produced. Thus, the noise produced when the carriage 38 is reciprocated is minimized. In addition, since the holding portion 105 and the restrictor wall 37 are prevented from abutting on each other, the ink tubes 41 are uniformly contacted with the rear-side surface of the wall 37 and accordingly the steel wire rod constituting the loop 107 of the holding portion 105 does not produce any local stresses in the tubes 41.

As is apparent from the foregoing description of the MFD 1, the pivotable support member 100 is pivotable about the supporting point (i.e., the shaft portion 102) located inside the respective U-shaped curved portions of the ink tubes 41 and the flat cable 85, the support portion 104 of the support member 100 supports the flat cable 85 such that the cable 85 is slideable on the support portion 104, and the holding portion 105 of the support member 100 holds the lengthwise pre-selected portions of the ink tubes 41 such that the tubes 41 are slideable relative to the holding portion 105. Therefore, when the ink tubes 41 change their shapes, the main arm portion 103 is pivoted, and the support portion 104 and the holding portion 105 that are integral with the main arm portion 103 support the ink tubes 41 and the flat cable 85 such that those elements 41, 85 can follow the reciprocation of the carriage 38. Thus, the sagging of the flat cable 85 and the scattering and/or sagging of the ink tubes 41 can be prevented and, because those elements 41, 85 are prevented from contacting the peripheral members, the damaging of those elements 41, 85 can be prevented. In addition, since the ink tubes 41 and the flat cable 85 are prevented from contacting the peripheral members, the reciprocating movement of the carriage 38 can be stabilized. Moreover, since the support portion 104 supports the flat cable 85 such that the cable 85 is slideable thereon, the cable 85 is not subjected to an excessively large load and accordingly is prevented from being damaged.

The torsion coil spring 132 biases the pivotable support member 100 in the direction to decrease the diameters of the curved portions of the ink tubes 41, i.e., flex those curved portions to decrease the radii of curvature thereof. Therefore, the swelling of the curved portions of the ink tubes 41 can be restrained and those curved portions can be prevented from expanding into the range of reciprocation of the carriage 38. In addition, the tube guide 141 is provided on the upstream side of the most upstream tube joint 142*a* (in the sheet-feed direction) of the tube connection portion 140 provided on the carriage 38. Therefore, the direction in which the most upstream ink tube 41 as seen in the sheet-feed direction is led from the most upstream tube joint 142*a* can be deflected to the direction toward the centers of the curved portions of the ink tubes 41. That is, the curved portions of the ink tubes 41 are so restricted as to decrease the diameters of those curved portions, and accordingly the swelling of the curved portions can be more effectively restrained.

While the present invention has been described in its preferred embodiment, it is to be understood that the present invention is not limited to the details of the above-described first embodiment but may be otherwise embodied.

For example, in the first embodiment, the second arm portion 135 of the torsion coil spring 132 is engaged with the main arm portion 103 of the pivotable support member 100 so as to apply the biasing force to the support member 100 in the pre-selected direction. However, the second arm portion 135 of the torsion coil spring 132 is engaged with the auxiliary arm portion 106 of the support member 100 so as to apply the biasing force to the support member 100 in the same direction. To this end, the coil spring 132 may be provided either on the upper side of the base plate 110 or on the lower side of the same 110. Meanwhile, in the present embodiment, the torsion coil spring 132 is employed as a sort of spring member that applies a torque to the pivotable support member 100. However, any other sort of biasing member or device may be employed so long as it can elastically bias the pivotable support member 100 in the direction to move the ink tubes 41 toward the restrictor wall 37.

Hereinafter, there will be described a second embodiment of the present invention. In the above-described first embodiment, the flat cable 85 is located inside the U-shaped curved portions of the ink tubes 41. However, it is preferred that one of (A) the ink tubes 41 and (B) the flat cable 85 that is more flexible than the other be located inside the other. Generally, it is conceived that the single flat cable 85 is more flexible than the four ink tubes 41. However, in the case where the total number of the ink tubes 1 is smaller or in the case where a plurality of flat cables 85 are bundled or a plurality of covering sheets are used to electrically insulate the single flat cable 85, the ink tube(s) 41 may be more flexible than the flat cable(s) 85. The ink tubes 41 and the flat cable 85 form the respective curved portions whose diameters assure that when those elements 41, 85 change their shapes to follow the carriage 38, those curved portions are not buckled. One of (A) the ink tubes 41 and (B) the flat cable 85 that is more flexible than the other can form the curved portion(s) whose diameter(s) can be more easily reduced than the other. In the case where one of (A) the ink tubes 41 and (B) the flat cable 85 that is more flexible than the other is located inside the other, the space needed to accommodate the changing of respective shapes of those elements 41, 85 can be reduced, which leads to reducing the overall size of the printer portion 2 or the MFD 1. Thus, the arrangement of the ink tubes 41 and the flat cable 85 may be reversed. In the second embodiment, the flat cable 85 is located outside the U-shaped curved portions of the four ink tubes 41.

Figure 20:
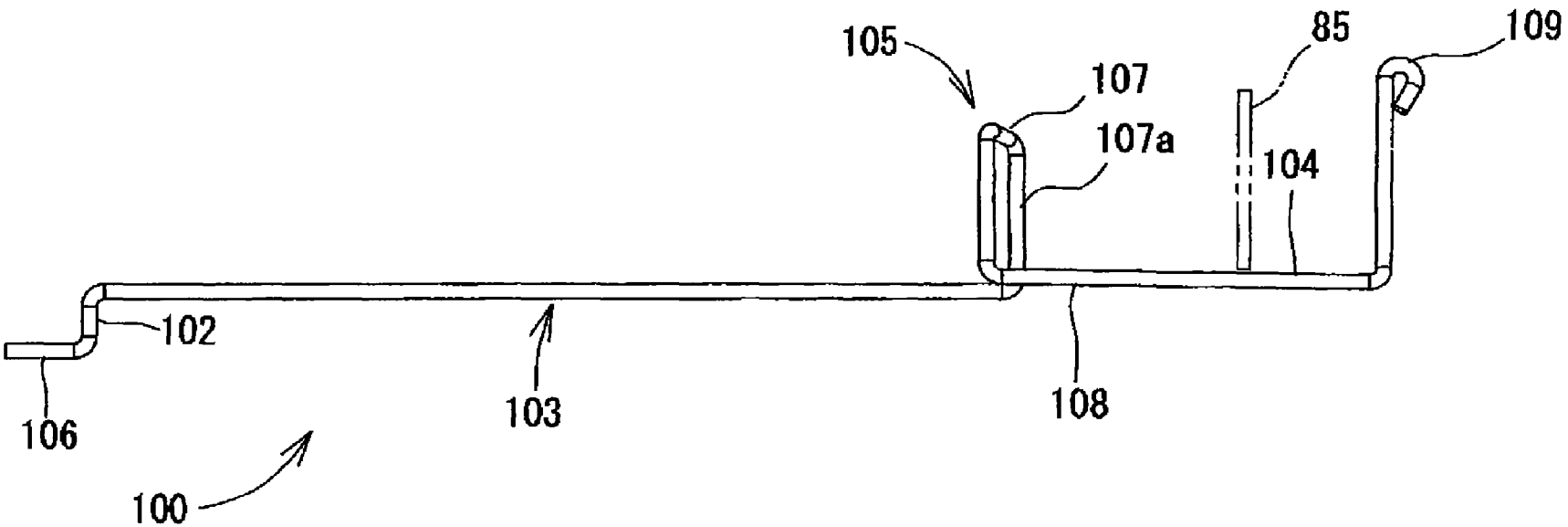
FIG. 20 is a front elevation view corresponding to FIG. 8, showing another pivotable support member 100 employed by another printer portion 2 of another MFD 1 as a second embodiment of the present invention.

As shown in FIG. 20, in the second embodiment, a pivotable support member 100 has a support portion 104 as a second support portion that is continuous with a base portion 108 of a loop 107. That is, the support portion 104 is constituted by a straight extension of a steel wire rod from the base portion 108 in an outward direction in which a main arm portion 103 extends from a shaft portion 102. A rounded portion 109 is constituted by an additional straight extension of the steel wire rod from the support portion 104 in an upward direction. A length of the support portion 104 in the outward direction is selected based on a length of a portion of the flat cable 85 that is made slideable on the support portion 104. Thus, a lower end of the flat cable 85 is supported by the support portion 104 such that the flat cable 85 is slideable thereon. Owing to the rounded portion 109, the flat cable 85 is prevented from contacting a free end of the steel wire rod that would otherwise remain sharp. Thus, the flat cable 85 can be effectively prevented from being damaged or broken.

In addition, as shown in FIG. 20, the rounded portion 109 extends upward such that a top end thereof is higher than that of the flat cable 85. Owing to this feature, too, the flat cable 85 is prevented from contacting the free end of the steel wire rod that would otherwise remain low. Moreover, the rounded portion 109 contacts not a particular portion of the flat cable 85 in the vicinity of a lower end thereof, but the entirety of one of the opposite major surfaces thereof Therefore, the flat cable 85 can be effectively prevented from being damaged or broken.

In each of the first and second embodiments, the pivotable support member 100 is pivoted while the same 100 is supported on the upper surface of the base plate 110 and the holding portion 105 of the main arm portion 103 supports, from the underside, the four ink tubes 41. However, a holding portion of a pivotable support member may be pendent from a main arm portion thereof.

Hereinafter, there will be described a third embodiment of the present invention, by reference to FIGS. 21 and 22. In the third embodiment, a pivotable support member 150 is employed in place of the pivotable support member 100 shown in FIG. 8 or FIG. 20.

The pivotable support member 150 includes a shaft portion 152 as a pivotal-motion supporting point; a main arm portion 153 extending horizontally from the shaft portion 152; a holding portion 155 as a first support portion that is constituted by a free end portion of the main arm portion 153; and an auxiliary arm portion 156 extending, like a crank, from the shaft portion 152 and the main arm portion 153. The shaft portion 152, the main arm portion 153, the holding portion 155, and the auxiliary arm portion 156 are integrally formed with each other by bending a single steel wire rod. Since the shaft portion 152, the main arm portion 153, and the auxiliary arm portion 156 of the pivotable support member 150 correspond to the shaft portion 102, the main arm portion 103, and the auxiliary arm portion 106 of the pivotable support member 100, the detailed description thereof is omitted.

The holding portion 155 as the free end portion of the main arm portion 153 is for holding the four ink tubes 41 by surrounding the same 41. The holding portion 155 includes a loop 157; a base portion 158 projecting outward from the loop 157; and a rounded portion 109 as a free end portion of the base portion 158. The third embodiment resembles the second embodiment in that the flat cable 85 is located outside the U-shaped curved portions of the ink tubes 41, and the pivotable support member 150 resembles the pivotable support member 100 employed in the second embodiment in that the pivotable support member 150 includes a support portion 154 as a second support portion that is continuous with the base portion 158 of the loop 157 and supports the flat cable 85. The four ink tubes 41 are passed through the loop 157 of the holding portion 155. A dimensional relationship between inner length (height) and width of the loop 157 of the pivotable support member 150 and respective outer diameters of the four ink tubes 41 is the same as described above with respect to the loop 107 of the pivotable support member 100 employed in the first or second embodiment. Therefore, the order of arrangement of the four tubes 41 does not change in the loop 157, and the four tubes 41 can slide relative to the loop 157 in a direction of extension of the tubes 41. The base portion 158 of the loop 157 is spaced from the main arm portion 153 in a direction intersecting the direction of extension of the same 153, and extends in substantially the same direction as the extension direction of the same 153. A free end portion of the base portion 158 is first bent upward and then is rounded downward like an arc to form the rounded portion 159. A top portion 160 of the loop 157 is formed by first bending upward the other end portion of the base portion 158 and then bending the same horizontally toward the main arm portion 153. Thus, the top portion 160 extends in a direction intersecting the direction of extension of the main arm portion 153.

Figure 21:
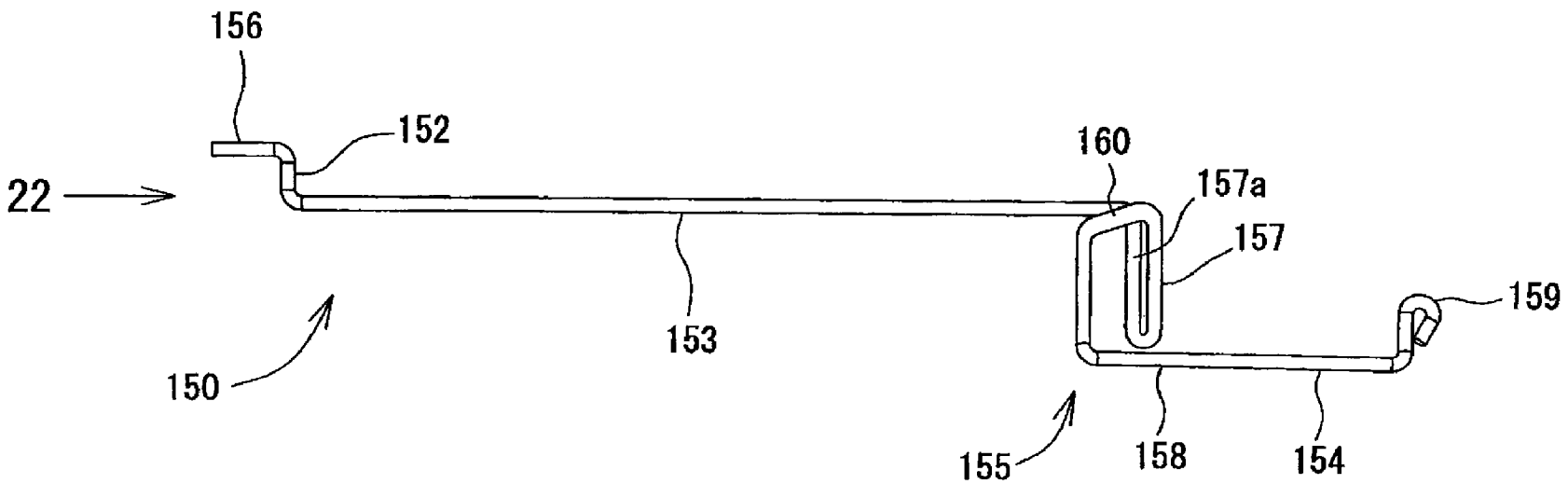
FIG. 21 is a front elevation view corresponding to FIG. 8, showing another pivotable support member 150 employed by another printer portion 2 of another MFD 1 as a third embodiment of the present invention.
Figure 22:
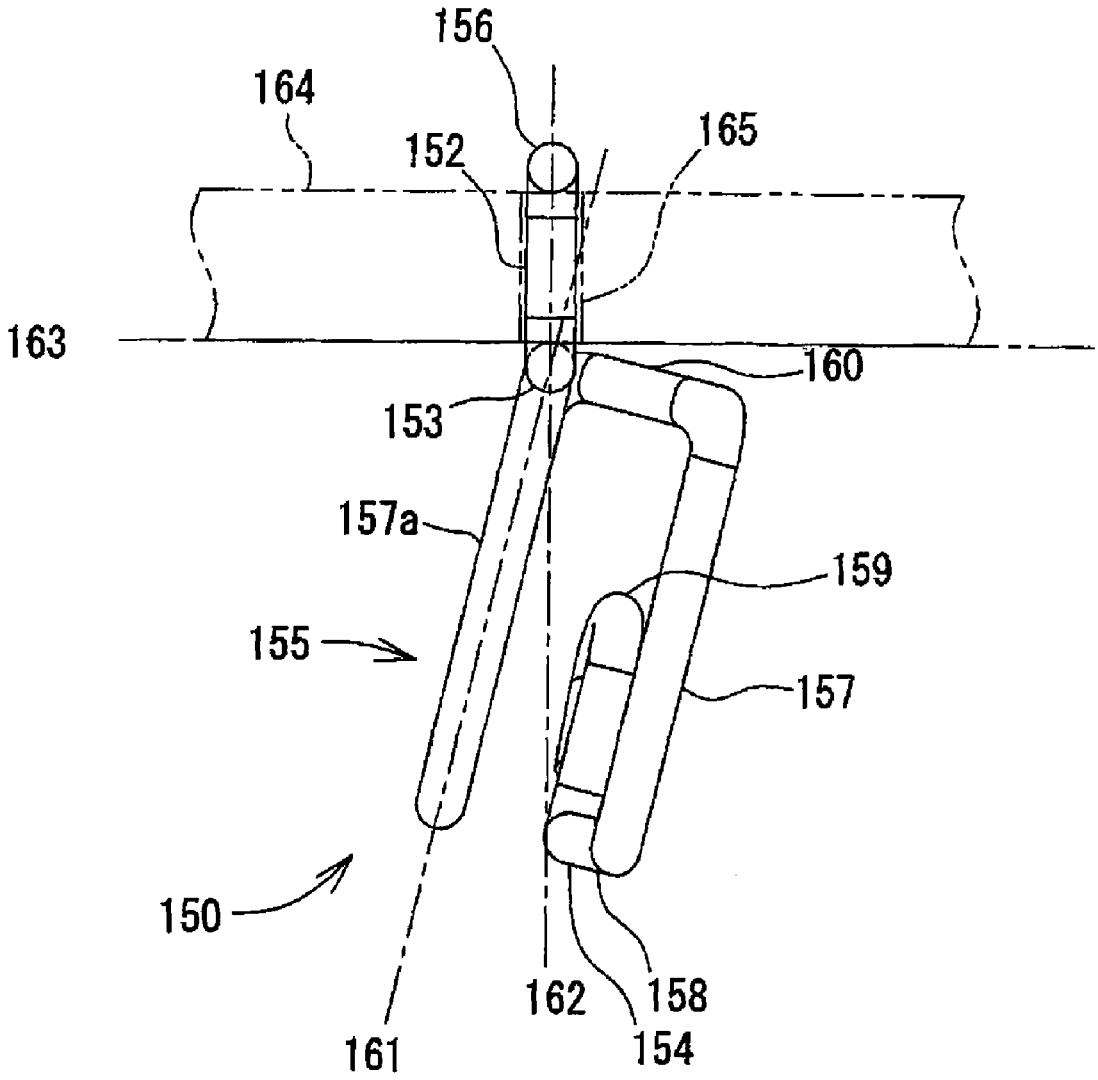
FIG. 22 is a side elevation view corresponding to FIG. 9, showing the pivotable support member 150 as seen in a direction indicated by Arrow 22 in FIG. 21.
Figure 23:
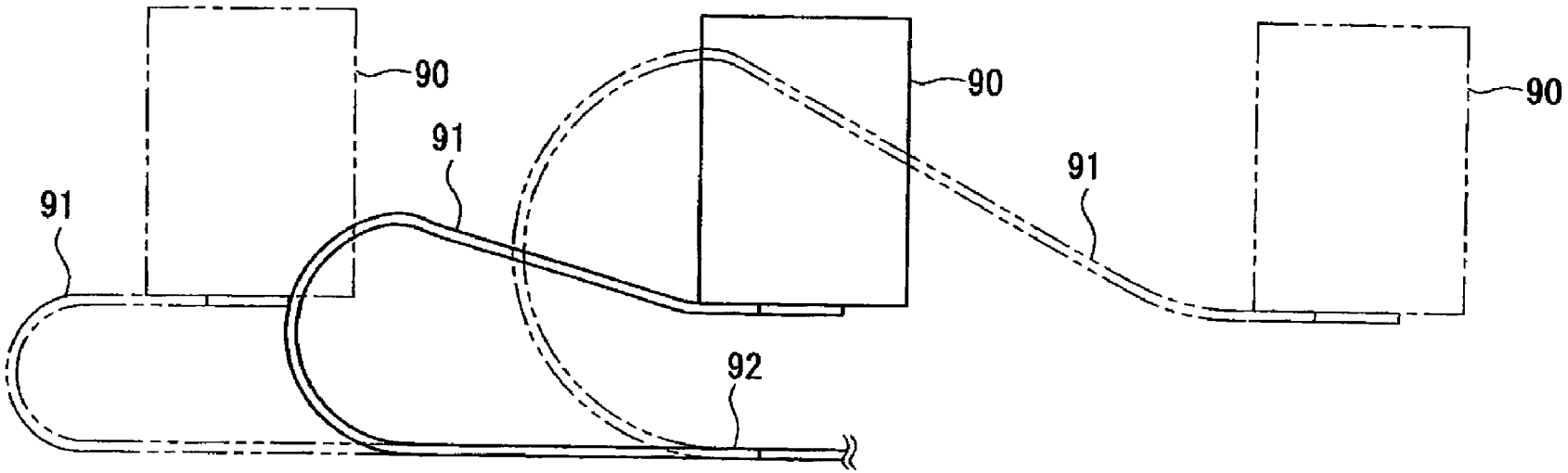
FIG. 23 is an illustrative view of a conventional image recording apparatus including a carriage 90 and a flat cable 91.

As shown in FIG. 21, the pivotable arm member 150 further includes a pendent portion 157*a* that is pendent from the main arm portion 153 and connects the same 153 to the loop 157. As shown in FIG. 22, an axis line 161 (i.e., a centerline of the steel wire rod) of the pendent portion 157*a* is inclined relative to an axis line 162 (.e., a centerline of the steel wire rod) of the shaft portion 152. More specifically described, the axis line 162 of the shaft portion 152 is vertical, whereas the axis line 161 of the pendent portion 157*a* is inclined relative to a vertical direction. Thus, the inclined pendent portion 157*a* is provided on an opposite side of the horizontal main arm portion 153 that is opposite to the top portion 160. Since the loop 157 has a rectangular shape elongate in a direction parallel to the inclined axis line 161, the fact that the inclined pendent portion 157*a* is provided opposite to the top portion 160 with respect to the horizontal main arm portion 153 means that the top portion 160 has a position lower than the horizontal main arm portion 153. That is, the top portion 160 of the loop 157 is provided opposite to a base plate 164 that pivotally supports the shaft portion 152, with respect to a plane 163 on which the main arm portion 103 is pivoted.

The base plate 164 is constituted by a flat member having a holding hole 165 that pivotally supports the shaft portion 152, and is fixed to a housing 2*b* of a printer portion 2 or an MFD 1. The main arm portion 153 is pivoted along a lower surface of the base plate 164 and, within a portion of a range of pivotal motion of the same 153, the holding portion 155 is entirely located right below the lower surface of the base plate 164. That is, the pivotable support member 150 is pendent from the base plate 164 such that the same 150 is pivotable about the axis line 162 of the shaft portion 152.

Thus, the third embodiment can enjoy the same advantages as those of the first or second embodiment. That is, the sagging of the flat cable 85 and the scattering and/or sagging of the ink tubes 41 can be prevented and, because those elements 41, 85 are prevented from contacting peripheral members, the damaging of those elements 41, 85 can be prevented. In addition, since the ink tubes 41 and the flat cable 85 are prevented from contacting the peripheral members, the reciprocating movement of the carriage 38 can be stabilized. Moreover, since the support portion 154 supports the flat cable 85 such that the cable 85 is slideable thereon, the cable 85 is not subjected to an excessively great load and accordingly is prevented from being damaged.

It is to be understood that the present invention may be embodied with other changes and improvements that may occur to a person skilled in the art, without departing from the spirit and scope of the invention defined in the claims.

What is claimed is:

1. An image recording apparatus, comprising:

a housing;

a recording head which ejects droplets of at least one sort of ink and thereby records an image on a recording medium;

a carriage which is provided in the housing and which carries the recording head and reciprocates in opposite directions intersecting a feeding direction in which the recording medium is fed, wherein the carriage includes a tube connection portion;

at least one ink supply tube which is connected, at one end thereof, to the tube connection portion of the carriage so as to supply said at least one sort of ink to the recording head, and is fixed, at a fixed portion thereof, to the housing such that an intermediate portion thereof located between said one end thereof and said fixed portion thereof forms a first curved portion that is convex in one of said opposite directions, wherein said at least one ink supply tube has a first flexibility assuring that when the carriage reciprocates, said at least one ink supply tube follows reciprocation of the carriage while said first curved portion thereof changes a shape thereof;

a pivotable support member which is supported by the housing such that the pivotable support member is pivotable about a supporting point, wherein the pivotable support member includes an arm portion which extends from the supporting point and has a first support portion that supports a portion of the first curved portion of said at least one ink supply tube; and a biasing device which biases the pivotable support member in a biasing direction to cause the pivotable support member to pivot in a direction to decrease a radius of curvature of the first curved portion of said at least one ink supply tube.

2. The image recording apparatus according to claim 1, wherein the supporting point is located inside the first curved portion of said at least one ink supply tube, wherein the arm portion extends from the supporting point in a substantially horizontal direction, and wherein the first support portion comprises a holding portion which holds said portion of the first curved portion of said at least one ink supply tube such that said portion of the first curved portion is slideable relative to the holding portion.

3. The image recording apparatus according to claim 1, wherein the biasing device comprises a spring member which applies, to the pivotable support member, a torque to cause the pivotable support member to pivot about the supporting point, and wherein the spring member has a fixed end that is fixed to the housing, and an engaged end that is engaged with the arm portion of the pivotable support member.

4. The image recording apparatus according to claim 1, further comprising a restrictor member which is mounted on the carriage in a vicinity of the tube connection portion, and which deflects a direction in which said at least one ink supply tube extends from the tube connection portion, so that the radius of curvature of the first curved portion of said at least one ink supply tube is decreased.

5. The image recording apparatus according to claim 1, comprising a plurality of said ink supply tubes which are connected, at respective one ends thereof, to the tube connection portion of the carriage so as to respectively supply a plurality of sorts of said inks to the recording head, and are fixed, at respective fixed portions thereof to the housing such that respective intermediate portions thereof located between said respective one ends thereof and said respective fixed portions thereof form respective first curved portions each of which is convex in said one of said opposite directions, wherein the ink supply tubes has respective first flexibilities assuring that when the carriage reciprocates, the ink supply tubes follow the reciprocation of the carriage while said respective first curved portions thereof change respective shapes thereof, and wherein the first support portion of the pivotable support member supports respective portions of the respective first curved portions of the ink supply tubes, such that said respective portions of the respective first curved portions are arranged in a predetermined order.

6. The image recording apparatus according to claim 5, wherein the first support portion of the pivotable support member supports said respective portions of the respective first curved portions of the ink supply tubes, such that said respective portions of the respective first curved portions are slideable relative to the first support portion without changing said predetermined order.

7. The image recording apparatus according to claim 1, further comprising an electrically conductive cable which is connected, at one end thereof, to the carriage so as to transmit a recording-related signal to the recording head, and is fixed, at a fixed portion thereof, to the housing such that an intermediate portion thereof located between said one end thereof and said fixed portion thereof forms a second curved portion that is convex in said one of said opposite directions, wherein the electrically conductive cable has a second flexibility assuring that when the carriage reciprocates, the electrically conductive cable follows the reciprocation of the carriage while said second curved portion thereof changes a shape thereof, wherein the arm portion of the pivotable support member further includes a second support portion that supports a portion of the second curved portion of the electrically conductive cable.

8. The image recording apparatus according to claim 7, wherein the second support portion supports said portion of the second curved portion of the electrically conductive cable such that said portion of the second curved portion is slideable relative to the support portion.

9. The image recording apparatus according to claim 7, wherein said at least one ink supply tube and the electrically conductive cable are provided such that one of (A) the first curved portion of said at least one ink supply tube and (B) the second curved portion of the electrically conductive cable that has a higher one of the first flexibility and the second flexibility is located inside an other of (A) the first curved portion and (B) the second curved portion.

10. The image recording apparatus according to claim 3, wherein the spring member is selected from the group consisting of a torsion spring, a coil spring, a spiral spring, and a volute spring.

11. The image recording apparatus according to claim 3, wherein the spring member comprises a torsion coil spring.

12. The image recording apparatus according to claim 3, wherein the biasing device further comprises a stationary member which is fixed to the housing and which supports the fixed end of the spring member.

13. The image recording apparatus according to claim 12, wherein the stationary member comprises a tubular member having an opening through which the arm portion of the pivotable support member extends in an outward direction from the supporting point located inside the tubular member, and wherein the opening defines an angular range in which the arm portion is pivotable about the supporting point.

14. The image recording apparatus according to claim 13, wherein the tubular member comprises a hollow cylindrical member having, as said opening, an upward opening recess which opens upward in an upper end of the cylindrical member and through which the arm portion of the pivotable support member extends from the supporting point in a substantially horizontal direction, and wherein the upward opening recess defines the angular range in which the arm portion is pivotable about the supporting point along a substantially horizontal plane.

15. The image recording apparatus according to claim 13, wherein the tubular member further has a support recess which opens in said opening and which supports the fixed end of the spring member such that the fixed end the spring member is engaged with the support recess so as to be fixed to the tubular member.

16. The image recording apparatus according to claim 1, wherein the pivotable support member further includes a shaft portion which has a vertical axis line and defines the supporting point, and from which the arm portion extends substantially perpendicularly from the shaft portion in the substantially horizontal direction, and wherein the apparatus further comprises a base plate which is fixed to the housing and which has a holding hole that supports the shaft portion of the pivotable support member such that the arm portion of the pivotable support member is pivotable about the vertical axis line of the shaft portion.

17. The image recording apparatus according to claim 1, further comprising a restrictor wall which is fixed to the housing and extends parallel to the opposite directions in which the carriage reciprocates, wherein the biasing device biases the pivotable support member in the biasing direction toward the restrictor wall, so as to decrease the radius of curvature of the first curved portion of said at least one ink supply tube.

18. The image recording apparatus according to claim 17, wherein the restrictor wall has a receiving recess which is capable of receiving at least a portion of the first support portion of the pivotable support member.

19. The image recording apparatus according to claim 1, wherein the supporting point is stationary relative to the housing such that when the carriage reciprocates in said opposite directions, the supporting point does not move relative to the housing.

* * * * *